US011530468B2

(12) United States Patent
Wu et al.

(10) Patent No.: US 11,530,468 B2
(45) **Date of Patent: *Dec. 20, 2022**

(54) HIGH-ENTROPY ALLOYS WITH HIGH STRENGTH

(71) Applicant: THE TRUSTEES OF DARTMOUTH COLLEGE, Hanover, NH (US)

(72) Inventors: Margaret Wu, West Lebanon, NH (US); Ian Baker, Etna, NH (US)

(73) Assignee: THE TRUSTEES OF DARTMOUTH COLLEGE, Hanover, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/251,769

(22) PCT Filed: Jun. 11, 2019

(86) PCT No.: PCT/US2019/036629

§ 371 (c)(1),
(2) Date: Dec. 11, 2020

(87) PCT Pub. No.: WO2019/241303

PCT Pub. Date: Dec. 19, 2019

(65) Prior Publication Data

US 2021/0130936 A1 May 6, 2021

Related U.S. Application Data

(60) Provisional application No. 62/684,064, filed on Jun. 12, 2018.

(51) Int. Cl.
*C22C 30/00* (2006.01)

(52) U.S. Cl.
CPC ..... *C22C 30/00* (2013.01); *C22C 2202/00* (2013.01)

(58) Field of Classification Search
CPC ..... C22C 38/58; C22C 30/00
See application file for complete search history.

(56) References Cited

U.S. PATENT DOCUMENTS

| | | | | |
|---|---|---|---|---|
| 8,394,210 | B2 | 3/2013 | Cao et al. | |
| 10,190,197 | B2 * | 1/2019 | Baker | C21D 6/005 |
| 2007/0125454 | A1 | 6/2007 | Eipper et al. | |
| 2009/0277558 | A1 | 11/2009 | Kikuchi et al. | |
| 2017/0167003 | A1 | 6/2017 | Baker et al. | |

OTHER PUBLICATIONS

International Patent Application No. PCT/US2019/036629, International Search Report and Written Opinion dated Sep. 10, 2019, 7 pgs.

* cited by examiner

*Primary Examiner* — Jessee R Roe
(74) *Attorney, Agent, or Firm* — Lathrop GPM LLP

(57) ABSTRACT

The disclosure provides high strength high-entropy alloys with compositions (in atomic %) of $Fe_aNi_bMn_cAl_dCr_eC_f$ where 37-43 atomic %, b is 8-14 atomic %, c is 27-33 atomic %, d is 4-10 atomic %, e is 10-14 atomic %, and f is 0-2 atomic %.

13 Claims, 17 Drawing Sheets

FIG 2A
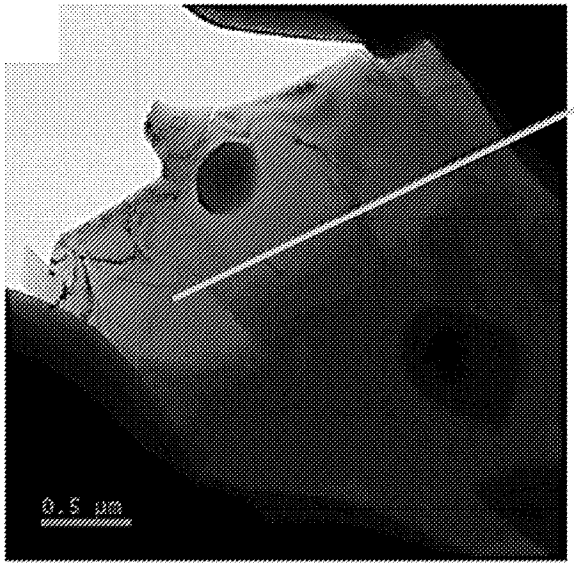
FIG 2B
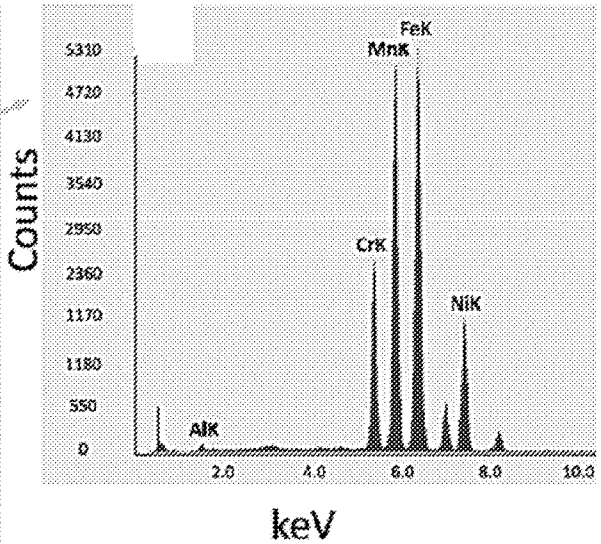
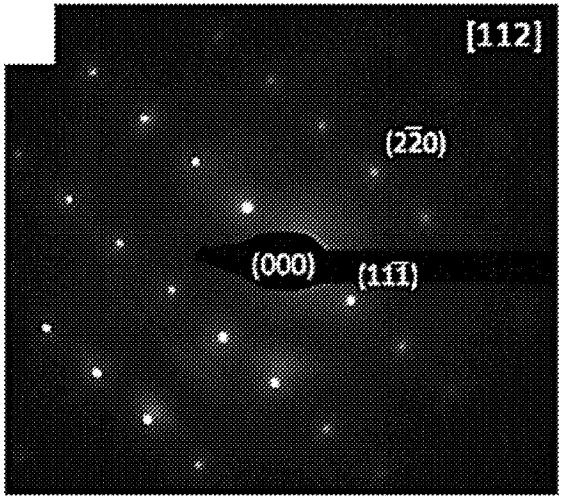
FIG 2C

5 µm

5 µm

5 µm

2 µm

2 µm

5 µm

5 µm

5 µm

1 µm

1 µm

HIGH-ENTROPY ALLOYS WITH HIGH STRENGTH

CROSS-REFERENCE TO RELATED APPLICATIONS

This application is a 35 U.S.C. § 371 filing of International Application No. PCT/US2019/036629 filed Jun. 11, 2019, which claims the benefit of U.S. Provisional Application No. 62/684,064, filed Jun. 12, 2018, the entire content of which is incorporated herein by reference.

GOVERNMENT RIGHTS

This invention was made with government support under grant no. DE-AC02-05CH11231 awarded by the U.S. Department of Energy. The government has certain rights in the invention.

BACKGROUND

In the past 15 years, high entropy alloys (HEAs), defined as containing five or more principal elements (5-45 atomic %), have emerged as a class of materials with promising mechanical properties [1], One of their widely quoted "core effects" is their high entropy of mixing which induces their stability as single-phase, typically f.c.c. or b.c.c. solid solutions [2], However, the enthalpy of formation for intermetallic compounds cannot be overridden in some HEA systems, resulting in multiphase alloys. For example, the eutectic HEA $AlCoCrFeNi_{2.1}$ has a f.c.c. ($L1_2$)/b.c.c. (B2) lamellar microstructure, with the latter phase containing Cr-enriched precipitates [3] [4], while $Al_{0.7}CoCrFeNi$ contains f.c.c. and spinodal B2+b.c.c. regions [5] [6], For both alloy systems, the hard B2 phase is an obstacle to dislocation motion while the softer, f.c.c. phase provides room-temperature ductility. However, large-scale industrial applications for such HEAs may be limited due to the high cost of cobalt. In contrast, more economical eutectic HEA systems like $Fe_{28.2}Ni_{18.8}Mn_{32.9}Al_{14.1}Cr_6$ (at. %) display a good combination of strength (~680 MPa) and ductility (~18%) due to their alternating f.c.c./B2 lamellar microstructure. It was previously reported that Cr further softened the f.c.c. phase by reducing its stacking fault energy and consequently decreasing the length of dislocation pile-ups at the f.c.c./B2 interface [7].

Aside from alleviating environmental embrittlement through a change in deformation mechanism for intermetallic compounds [8], [9], the addition of Cr is widely known to impart corrosion resistance in steels, making it a valuable element for high-temperature power generation systems.

In a number of high-temperature applications, particularly for use in industrial gas turbines, as well as engine members for aircraft, chemical plant materials, engine members for automobile such as turbocharger rotors, high temperature furnace materials and the like, high strength is needed, as well as excellent corrosion resistance.

SUMMARY

In an aspect, provided herein is a high-entropy alloy (HEA) having a formula of $Fe_aNi_bMn_cAl_dCr_eC_f$, wherein a is between 37-43 atomic %, b is between 8-14 atomic %, c is between 27-33 atomic %, d is between 4-10 atomic %, e is between 10-14 atomic %, and f is between 0-2 atomic %.

In one embodiment, the disclosure provides multiphase high-entropy alloy (HEA) with composition (in atomic %) of $Fe_{40.2}Ni_{11.3}Mn_{30}Al_{7.5}Cr_{11}$. The $Fe_{40.2}Ni_{11.3}Mn_{30}Al_{7.5}Cr_{11}$ high-entropy alloy displays an excellent combination of high strength and high ductility. The alloy displays a room-temperature yield strength of 593 MPa, elongation to fracture of 22%, and Vickers hardness value of 246. The presence of both Ni-rich, b.c.c. needle-shaped precipitates and Cr-rich, σ phase particles was observed for the 1173 K annealed specimen.

The discovery of a multi-phase HEA that contains at least 11% Cr and good mechanical properties has prevalent high-temperature structural applications especially in cases that require suitable corrosion resistance. With the substantial amounts of Cr and Al in the alloy it is expected to be very resistant to oxidation and corrosion.

Various embodiments, objects, features, and advantages will become more apparent from the following detailed description of the embodiments or may be learned by practice of the claimed invention. These objects and advantages will be realized and attained by the compositions and methods described and claimed herein. This summary section has been made with the understanding that it is to be considered as a brief and general synopsis of some of the embodiments disclosed herein, and is not intended to be used to limit the scope of the appended claims.

BRIEF DESCRIPTION OF THE FIGURES

The following figures form part of the present specification and are included to further illustrate aspects of the present disclosure.

FIG. 2A illustrates BF TEM image of an interdendritic region in the as-cast alloy; FIG. 2B illustrates TEM EDS spectrum displaying increased concentrations of Fe and Mn within the interdendritic region; and FIG. 2C illustrates corresponding [112] SADP (selected area electron diffraction pattern) indicating the crystal structure is f.c.c.

(FIG. 6B) 1223 K; and (FIG. 6C) 1273 K.

FIGS. 17A, 17B, and 17C-17G illustrates BF TEM images of the as-cast $Fe_{40.2}Ni_{11.3}Mn_{30}Al_{7.5}Cr_{11}$ after (FIGS. 17A and 17B) 1%, (FIGS. 17C and 17E) 10%, and (FIGS. 17F and 17G) 20% strain. For the interdendritic regions after (FIG. 17A) 1% strain, the dislocations are arranged as loops that become entangled upon further straining to (FIG. 17C) 10%. After (FIG. 17F) 20% strain, extensive cross-slip produces dislocation cells. In contrast, the dendritic regions remain relatively undeformed after (FIG. 17B) 1% strain, but after (FIG. 17E) 10% and (FIG. 17G) 20% strain, the b.c.c. dendritic regions consist of a higher dislocation density that accumulate around the hard B2 particles.

DETAILED DESCRIPTION

Definitions

Figure 1:
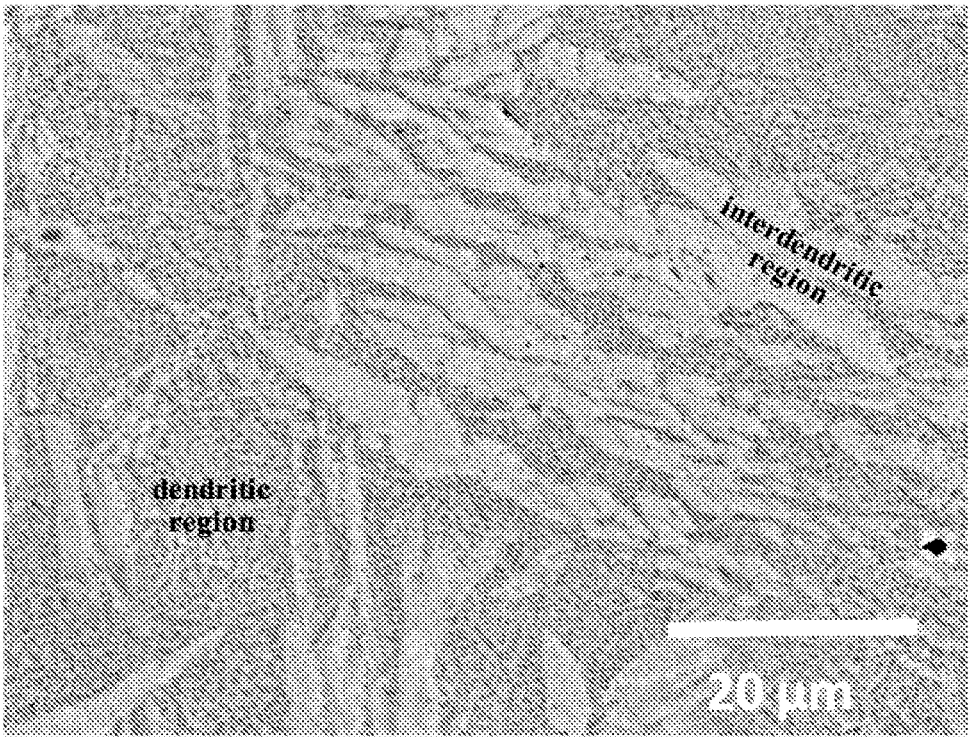
FIG. 1 illustrates BSE image of as-cast $Fe_{40.2}Ni_{11.3}Mn_{30}Al_{7.5}Cr_{11}$, which displays a dendritic-interdendritic microstructure.

It is to be understood that the terminology used herein is for the purpose of describing particular embodiments only, and is not intended to be limiting. As used in this specification and the appended claims, the singular forms "a," "an," and "the" include plural referents unless the context clearly dictates otherwise. Unless specifically stated or obvious from context, as used herein, the term "or" is understood to be inclusive and covers both "or" and "and."

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim.

Unless defined otherwise, all technical and scientific terms used herein have the same meaning as commonly understood by one of ordinary skill in the art to which the invention pertains. Although other methods, systems, and networks similar, or equivalent, to those described herein can be used in the practice of the present disclosure, the preferred materials and methods are described herein.

In an aspect, provided herein is a high-entropy alloy (HEA) having a formula of $Fe_aNi_bMn_cAl_dCr_eC_f$, wherein a is between 37-43 atomic %, b is between 8-14 atomic %, c is between 27-33 atomic %, d is between 4-10 atomic %, e is between 10-14 atomic %, and f is between 0-2 atomic %.

In one embodiment, the HEA has a formula of $Fe_aNi_bMn_cAl_dCr_eC_f$, wherein a is between 38-42 atomic %, b is between 9-13 atomic %, c is between 28-32 atomic %, d is between 5-9 atomic %, e is between 10-13 atomic %, and f is between 0.1-1.2 atomic %.

In another embodiment, the HEA has a formula of $Fe_aNi_bMn_cAl_dCr_eC_f$, wherein a is between 39-41 atomic %, b is between 10-12 atomic %, c is between 29-31 atomic %, d is between 6-8 atomic %, e is between 10-12 atomic %, and f is between 0.5-1.0 atomic %.

In another embodiment, the HEA has a formula of $Fe_aNi_bMn_cAl_dCr_e$, wherein a is between 37-43 atomic %, b is between 8-14 atomic %, c is between 27-33 atomic %, d is between 4-10 atomic %, and e is between 10-14 atomic %.

In another embodiment, the HEA has a formula of $Fe_aNi_bMn_cAl_dCr_e$, wherein a is between 38-42 atomic %, b is between 9-13 atomic %, c is between 28-32 atomic %, d is between 5-9 atomic %, and e is between 10-13 atomic %.

In another embodiment, the HEA has a formula of $Fe_aNi_bMn_cAl_dCr_e$, wherein a is between 39-41 atomic %, b is between 10-12 atomic %, c is between 29-31 atomic %, d is between 6-8 atomic %, e is between 10-12 atomic %.

In another embodiment, the HEA has a formula of $Fe_{40.2}Ni_{11.3}Mn_{30}Al_{7.5}Cr_{11}$.

In another embodiment, the HEA disclosed herein has a yield strength of at least 350 MPa, 400 MPa, 450 MPa, 500 MPa, or 550 MPa, at room temperature.

In another embodiment, the HEA disclosed herein has an elongation to failure of at least 20%, 25%, 30% or 35%.

In another embodiment, the disclosure provides a three-phase alloy which consists of FeMn-enriched laths and NiAl-rich precipitates inside Cr-concentrated regions. The alloy displays a room-temperature yield strength of 593 MPa, elongation to fracture of 22%, and Vickers hardness value of 246.

In one embodiment, the HEA disclosed herein displays a room-temperature yield strength of ~600 MPa which is higher than the RT yield strengths of 304 stainless steel (~320 MPa) and 316L stainless steel (~410 MPa). The corrosion rate as measured by current density is 28 $\mu A/cm^2$ which is significantly lower than the current density of 318 stainless steel.

In one embodiment, the HEA disclosed herein has potential high temperature applications in power plants and chemical plants.

In another aspect, the present disclosure provides a multiphase HEA having a formula of $Fe_aNi_bMn_cAl_dCr_e$, wherein a is between 37-43 atomic %, b is between 8-14 atomic %, c is between 27-33 atomic %, d is between 4-10 atomic %, and e is between 10-14 atomic %.

In one embodiment, the multiphase HEA has a formula of $Fe_aNi_bMn_cAl_dCr_e$, wherein a is between 38-42 atomic %, b is between 9-13 atomic %, c is between 28-32 atomic %, d is between 5-9 atomic %, and e is between IQ-13 atomic %.

In another embodiment, the multiphase HEA has a formula of $Fe_aNi_bMn_cAl_dCr_e$, wherein a is between 39-41 atomic %, b is between 10-12 atomic %, c is between 29-31 atomic %, d is between 6-8 atomic %, e is between 10-12 atomic %.

In one embodiment, the multiphase HEA comprises Fe in an amount of between 37-43 atomic %; Ni in an amount of between 8-14 atomic %; Mn in an amount of between 27-33 atomic %; Al in an amount of between 4-10 atomic %; and Cr in an amount of between 10-14 atomic %.

In one embodiment, the multiphase HEA comprises Fe in an amount of between 38-42 atomic %; Ni in an amount of between 9-13 atomic %; Mn in an amount of between 28-32 atomic %; Al in an amount of between 5-9 atomic %; and Cr in an amount of between 10-13 atomic %.

In one embodiment, the multiphase HEA comprises Fe in an amount of between 39-41 atomic %; Ni in an amount of between 10-12 atomic %; Mn in an amount of between 29-31 atomic %; Al in an amount of between 6-8 atomic %; and Cr in an amount of between 10-12 atomic %.

In one embodiment, the multiphase HEA has a formula of $Fe_{40.2}Ni_{11.3}Mn_{30}Al_{7.5}C_{11}$.

In one embodiment, as-cast $Fe_{40.2}Ni_{11.3}Mn_{30}Al_{7.5}C_{11}$ disclosed herein is comprised of a b.c.c./f.c.c. dendritic-interdendritic microstructure, in which spherical B2 precipitates are dispersed in the b.c.c. phase. High entropy alloys with similar dendritic-intendendritic microstructures have been previously reported by others. Tung et al. [10] explored the effects of varying the aluminum content (x=0 to 3 in molar ratio) on b.c.c./f.c.c. solid solution formation for $Al_xCoCrCuFeNi$ HEA, while Choudhuri et al. [11] investigated the primary and secondary solidification phases for AlxCrCuFeNi2 (x=0.8-1.0). Most notably, Tsai et al. [12] cast a $Al_{0.3}CrFe_{1.5}MnNi_{0.5}$ HEA displaying a b.c.c. and f.c.c. dendritic-interdendritic structure wherein NiAl-rich particles of B2-type are dispersed within the latter phase. The alloy displayed a rapid age-hardening phenomenon similar to the one developed in the present paper. Indeed, when $Fe_{40.2}Ni_{11.3}Mn_{30}Al_{7.5}Cr_{11}$ is annealed at 1173 K for 1 h, the Vickers hardness increases from the as-cast value of 246 HV to 439 HV. Further heat-treatment at 1223 K and 1273 K for 1 h, lowers the hardness values to 228 HV and 140 HV, respectively. To better understand the rapid age-hardening effect that occurs when $Fe_{40.2}Ni_{11.3}Mn_{30}Al_{7.5}Cr_{11}$ is annealed at 1173 K but not at 1223 K or 1273 K, XRD was performed on the heat-treated specimens. The alloy in the as-cast state and after its been annealed for 1 h at 1173 K, 1223 K, and 1273 K displays characteristic f.c.c. and b.c.c. peaks. However, the XRD pattern for the 1173 K annealed specimen displays a set of peaks that have replaced the $(110)_{BCC}$ peak in the as-cast alloy. These peaks correspond to the hard, FeCr-enriched σ phase which has been previously observed in the δ-ferrite islands of annealed 316L austenitic stainless steel as well as superferritic (Nb-28Cr-4Ni-2Mo wt. %), and ferritic-austenitic (22Cr-5.5Ni-3Mo-0.14N) stainless steels [13], The preferential formation of σ tetragonal phase in δ-ferrite is due to the faster rate of diffusion of σ-forming elements such as Cr in ferrite compared to that in austenite, while the precipitation of σ in austenite is notoriously sluggish due to its incoherency with austenite [14], In contrast, duplex stainless steels are most susceptible to a formation, especially between 923 K-1223 K, with maximum precipitation velocity occurring at approximately 1123 K [15], Thus, similar to duplex stainless steels, the σ phase in 1173 K annealed $Fe_{40.2}Ni_{11.3}Mn_{30}Al_{7.5}C_{11}$ precipitates at the γ/δ-ferrite interfaces within the dendritic regions. This is in contrast the work of Tsai et. al who observed a transformation of the entire dendritric regions from b.c.c. to σ phase in annealed $Al_{0.3}CrFe_{1.5}MnNi_{0.5}$.

In addition to a formation in the 1173 K annealed material, needle-shaped precipitates are observed within the f.c.c. interdendritic regions. To determine whether the needle-shaped precipitates or the σ precipitates contribute to the rapid hardening observed in 1173 K annealed samples, $Fe_{40.2}Ni_{11.3}Mn_{30}Al_{7.5}Cr_{11}$ was aged at 1173 K for 4 h and 100 h. The hardness values increase from 439 HV to 462 HV when the annealing time is increased from 1 h to 4 h, and then decreases to 406 HV after 100 h. Approximately equal volume fractions of needle-shaped precipitates are observed within the f.c.c. interdendritic regions for both the 1 h and 4 h annealed specimens, with a slight coarsening of the hard σ phase dendrite particles in the 4 h annealed specimen which can explain the hardness increase. However, needle-shaped precipitates are no longer present in the 100 h annealed specimen; instead, the dendritic particles have significantly coarsened and smaller spherical particles are observed within the dendrites as well. The latter is most likely due to particle dissolution and re-precipitation which is associated with overaging in precipitation-hardened alloys. The hardness value of 406 HV is still high compared to the as-cast value of 246 HV which suggests that the main hardening mechanism in $Fe_{40.2}Ni_{11.3}Mn_{30}Al_{7.5}Cr_{11}$ annealed at 1173 K is due to the presence of σ phase particles rather than the needle-shaped precipitates.

When the alloy is annealed at 1223 K for 1 h, the σ phase peaks disappear and the intensity of the (111) f.c.c. peak increases while the (110) b.c.c. peak decreases compared to the as-cast alloy. The decreased intensity for the $(110)_{BCC}$ peak could be due to the higher and lower volume fractions of the f.c.c. interdendrites and b.c.c. dendrites, respectively, in the 1223 K annealed specimen. Accordingly, the hardness value for the 1223 K annealed specimen of 229 HV has fallen below the as-cast value of 246 HV while the tensile strength has decreased from 593 MPa to 486 MPa and the elongation to fracture has increased from 22% to 27%. When $Fe_{40.2}Ni_{11.3}Mn_{30}Al_{7.5}Cr_{11}$ is annealed at 1273 K for 1 h, most of the b.c.c. peaks have disappeared except for the higher angle peak at $2\theta=73.6°$. Examining the microstructure, one can see that the specimen mostly consists of an f.c.c. matrix with a low volume fraction of B2 precipitates (8.5%) compared to the higher volume fraction of B2 precipitates observed for the 1173 K annealed specimen (16.7%). Additionally needle-shaped precipitates are no longer present in the specimen annealed at 1273 K. Accordingly, the hardness value and tensile strength of the alloy annealed at 1273 K is lowest at 140 HV and 228 MPa, respectively, while the elongation to fracture is highest at 40%. The corresponding fracture surfaces for the alloy in the as-cast condition and after it has been aged for 1 h at 1173 K and 1223 K all show dimple-type rupture as well as the presence of microvoids that increase with an increase in annealing temperature. Thus, the strengthening component for as-cast $Fe_{40.2}Ni_{11.3}Mn_{30}Al_{7.5}Cr_{11}$ may be attributed to the B2 precipitates/b.c.c. dendritic regions which display a higher local hardness value of 426 HV compared to the interdendrites (235 HV).

To further investigate the mechanical behavior of as-cast $Fe_{40.2}Ni_{11.3}Mn_{30}Al_{7.5}Cr_{11}$, the deformation microstructures of variously strained specimens were examined. The dislocation substructures for the as-cast alloy after 1% strain show that the f.c.c. intedendrites undergo deformation before the b.c.c. dendrites, i.e. there is a higher dislocation density in the former regions at low strain. The role of austenite as the softer phase in f.c.c./b.c.c. alloy systems has been previously noted [16], For a series of eutectic FeNiMnAl alloys comprised of alternating f.c.c./b.c.c. lamellae, the dislocation pile-ups in the f.c.c. phase at the f.c.c./B2 interface led to cracking in the latter phase, and ultimately failure [17], Therefore, by increasing the f.c.c. lamellae width by decreasing the Al content, cracking was delayed in the B2 phase until higher strains were achieved. Upon further straining to 10% in the present alloy system, wavy slip characterizes the deformation structure for the interdendrites as evidenced by the tangled dislocations and eventual dislocation cells that are observed at the f.c.c./b.c.c. interface after 10% and 20% strain, respectively. In comparison, the dendritic regions consisting of a b.c.c./B2 dual phase serve as obstacles to dislocation motion and moreover, the B2 precipitates reinforce the already hard b.c.c. phase as evidenced by the accumulation of dislocations around the B2 particles. Therefore, the combination of soft, f.c.c. interdendritic regions and hard b.c.c./B2 dendritic regions imparts the high strength and ductility observed for as-cast $Fe_{40.2}Ni_{11.3}Mn_{30}Al_{7.5}C_{11}$ during room temperature deformation.

In one embodiment, $Fe_{40.2}Ni_{11.3}Mn_{30}Al_{7.5}C_{11}$ disclosed herein displays an excellent balance of high strength and high ductility. Based on the examination of undeformed and deformed specimens, the following conclusions can be drawn:

1. As-cast $Fe_{40.2}Ni_{11.3}Mn_{30}Al_{7.5}C_{11}$ is comprised of a Cr-rich, b.c.c. and Fe,Mn-rich f.c.c. dendritic-interdendritic microstructure with Ni-rich, B2 particles dispersed within the former phase.

2. Upon annealing the alloy at 1173 K for 1 h, two types of precipitates appear: (1) Cr-rich, σ phase particles at the dendritic-interdendritic interfaces and (2) Ni-rich, b.c.c. needleshaped precipitates in the interdendritic regions. The corresponding hardness drastically increases from the as-cast value of 246 HV to 439 HV. After prolonged annealing at 1173 K for 100 h, an elevated hardness value of 406 HV is maintained while the needle-shaped, b.c.c. particles—but not the σ phase—have dissolved, indicating that the σ phase serves as the main source of age hardening for the alloy annealed at 1173 K.

3. A decrease in the volume fraction of B2 particles and a corresponding drop in room temperature yield strength from the as-cast value of ~593 MPa to ~486 MPa and ~228 MPa is observed for the specimens annealed at 1223 K and 1273 K, respectively. An accompanying increase in elongation to fracture from the as-cast value of ~22% to ~27% and ~40% is also noted for the 1223 K and 1273 K annealed specimens, respectively.

4. The fracture surfaces for the alloy in the as-cast and annealed conditions all exhibit dimple-type rupture, with the largest microvoids observed for the 1273 K-annealed specimen, which also displays the greatest ductility.

5. The high strength and high ductility observed during the room-temperature deformation of the as-cast alloy can be attributed to the cooperation between the soft, f.c.c. interdendrites which deform by wavy slip and the hard, b.c.c./B2 dendrities which deform after the f.c.c. phase and serve as obstacles to dislocation motion.

In one embodiment, the present disclosure provides multiphase high entropy alloy (HEA) with composition (in atomic %) of $Fe_{40.2}Ni_{11.3}Mn_{30}Al_{7.5}Cr_{11}$. In one embodiment, the presence of both Ni-rich, b.c.c. needle-shaped precipitates and Cr-rich, σ phase particles was observed for the 1173 K annealed specimen. The σ phase precipitates contributed to the rapid age-hardening effect in the material annealed at 1173 K. A further increase in ageing temperature to 1223 K and 1273 K led to the dissolution of the σ phase and a reduction in the volume fraction of the b.c.c./B2 dendrites, which led to a consequent drop in room-temperature yield strength from the as-cast value of ~593 MPa to ~486 MPa and ~228 MPa for the specimens annealed at 1223 K and 1273 K, respectively. An accompanying increase in ductility was observed from ~22% for the as-cast alloy to ~27% and ~40% after annealing the material at 1223 K and 1273 K, respectively. Post-deformation transmission electron micrographs revealed that the f.c.c interdendrites accommodated plastic strain via wavy slip and moreover, deformed before the b.c.c. dendritic regions, which were reinforced by B2 particles and acted as obstacles to moving dislocations.

In one embodiment, in the as-cast state, the HEA disclosed herein is a three-phase alloy which consists of FeMn-enriched laths and NiAl-rich precipitates inside Cr-concentrated regions. The alloy displays a room-temperature yield strength of 593 MPa, elongation to fracture of 22%, and Vickers hardness value of 246. In one embodiment, the HEA has a formula of $Fe_{40.2}Ni_{11.3}Mn_{30}Al_{7.5}Cr_{11}$.

Addition of carbon (C) may contribute to the improvement in the high temperature strength of the alloys. The carbon additions may not only increase the yield strength, but also increase both the elongation to failure and the work-hardening rate, and for higher carbon contents the work-hardening rate also increases with increasing strain. In some embodiments, the HEA disclosed herein comprises C in amounts of 0.01-2 atomic %, 0.5-1.5 atomic %, or 0.7-1.2 atomic %.

In another aspect, the present disclosure provides a method to manufacture a high-entropy alloy disclosed herein. In one embodiment, the starting materials were 99.97% Fe, 99.90% Mn, 99.95% Ni, and 99.70% Al, and 99% Cr. In one embodiment, the method comprises the steps of melting 37-43 atomic % Fe, 8-14 atomic % Ni, 27-33 atomic % Mn, 4-10 atomic % Al, and 10-14 atomic % Cr, homogenization heat treatment, and cooling. In one embodiment, an additional 5 wt. % Mn was added due to its tendency to evaporate.

The melting is provided to allow the metal, having been manufactured, to be alloyed. A method thereof is not particularly limited, and a method commonly performed in a technical field of the present disclosure may be used. For example, the alloy may be manufactured through casting, arc melting, powder metallurgy, or the like.

In a high-entropy alloy, various elements are mixed, so homogenization heat treating is performed to induce sufficient diffusion. In one embodiments, all ingots were flipped and remelted twice following the initial melting to ensure homogeneity.

After the homogenization heat treating, cooling is performed. A method of the cooling is not particularly limited, and a method, such as water cooling, oil cooling, air cooling, or the like, may be performed.

In one embodiment, the HEA is cold rolled. In another embodiment, the HEA is further annealed at a temperature 1000-1100 K, 1100-1200K, or 1200-1300 K.

The invention illustratively described herein suitably can be practiced in the absence of any element or elements, limitation or limitations which is not specifically disclosed herein.

One of ordinary skill in the art will appreciate that starting materials, reagents, synthetic methods, purification methods, analytical methods, and assay methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

Thus, it should be understood that although the invention has been specifically disclosed by preferred embodiments and optional features, modification and variation of the concepts herein disclosed can be resorted to by those skilled in the art, and that such modifications and variations are considered to be within the scope of this invention as defined by the appended claims.

All references cited throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

EXAMPLES

Materials and Methods 62 g ingots of $Fe_{40.2}Ni_{11.3}Mn_{30}Al_{7.5}Cr_{11}$ (atomic %) were arc-melted in a water-chilled copper crucible under an argon atmosphere. The starting materials were 99.97% Fe, 99.90% Mn, 99.95% Ni, and 99.70% Al, and 99% Cr. Due to its high vapor pressure and, hence, tendency to evaporate, an additional 5 wt. % Mn was added. To ensure homogeneity, all ingots were flipped and re-melted twice following the initial melting. In order to examine the phase stability at elevated temperatures, the alloys were annealed for 1 h at 1173 K, 1223 K, and 1273 K. Vickers hardness tests were performed using a force of 1.96 N for a dwell time of 15 s. The hardness was measured five times for each heat treatment. For electron microscopy, disks 3 mm in diameter and 100 μm in thickness were mechanically milled and then electropolished in a Struers Tenupol 5 using 25% nitric acid in methanol at −20° C. at a current of ~100 mA and voltage of ~10 V. Microstructures were examined in backscattered electron (BSE) and secondary electron (SE) mode using a FEI XL-30 field emission gun (FEG) scanning electron microscope (SEM) and X-ray diffraction (XRD) measurements were performed using a Rigaku D/MAX 2000 XRD with Cu-Kα radiation and X-ray wavelength of 1.54 Å. The operating voltage and current were 40 keV and 300 mA, respectively. A step size of 0.02° was used. Crystal structures were determined using a FEI Tecnai F20 FEG transmission electron microscope (TEM) equipped with energy dispersive X-ray spectrometry (EDS), operating at 200 kV. Precipitate volume fractions were determined from binarized BSE images using ImageJ.

Room-temperature tensile tests were performed on the cold-rolled as-cast and the annealed dog-bone tensile specimens with gauge length ~10 mm, width ~2.65 mm, and thickness ~1.10 mm at an initial strain rate of $5\times10^{-4}$ $s^{-1}$ at room temperature. The dog-bone shaped specimens were polished using fine grades of silicon carbide papers from 400 to 1200 grit. The specimens' gauge lengths before and after testing were used to determine the elongation to fracture. To determine reproducibility, three tests were performed for each annealing condition.

Figure 3:
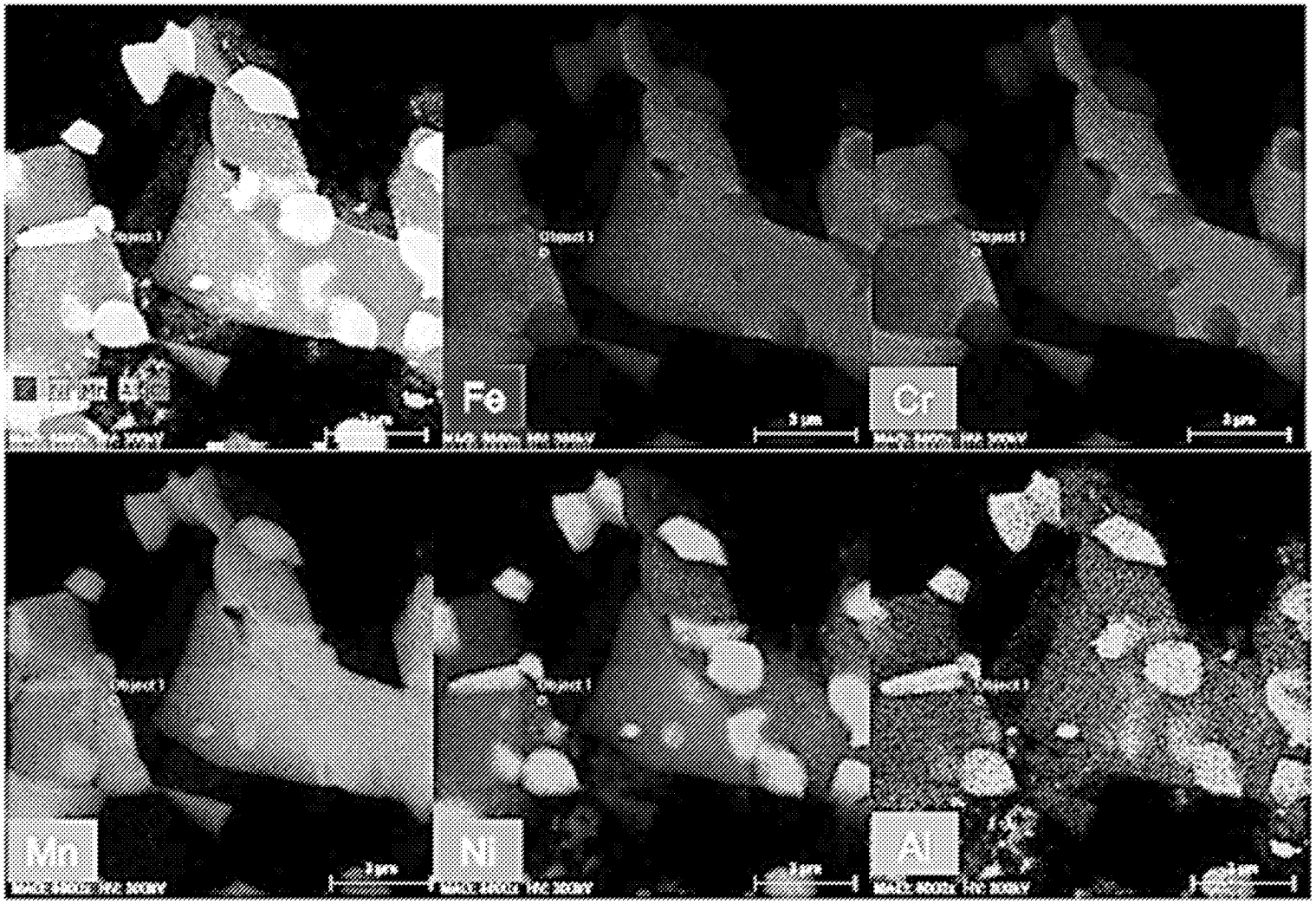
FIG. 3 illustrates STEM EDS maps of a dendritic region in the as-cast alloy, showing enrichment in Cr. The spherical precipitates within the dendrites are enriched in Ni, Mn, and Al.
Figure 4:
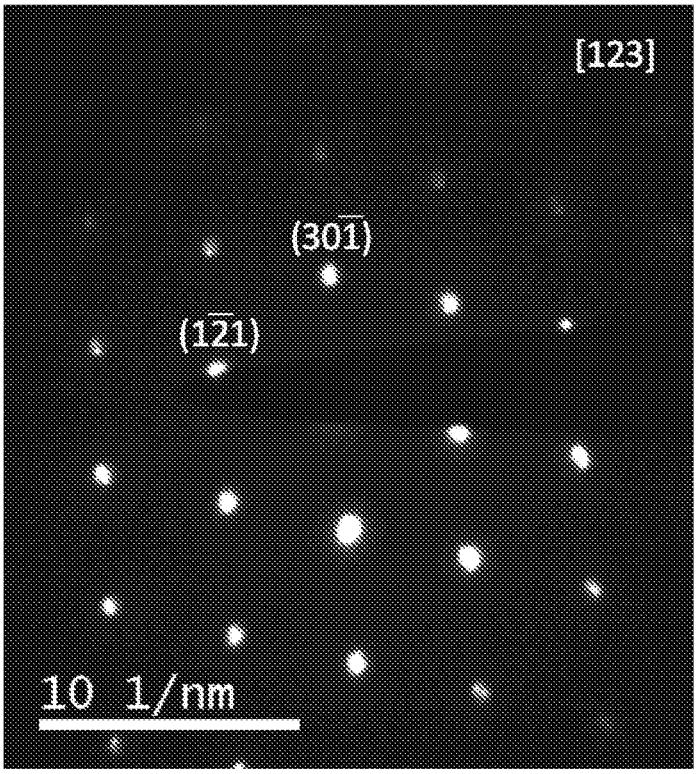
FIG. 4 illustrates [123] SADP from the dendritic region in as-cast $Fe_{40.2}Ni_{11.3}Mn_{30}Al_{7.5}Cr_{11}$, indicating a b.c.c. crystal structure.
Figure 5A:
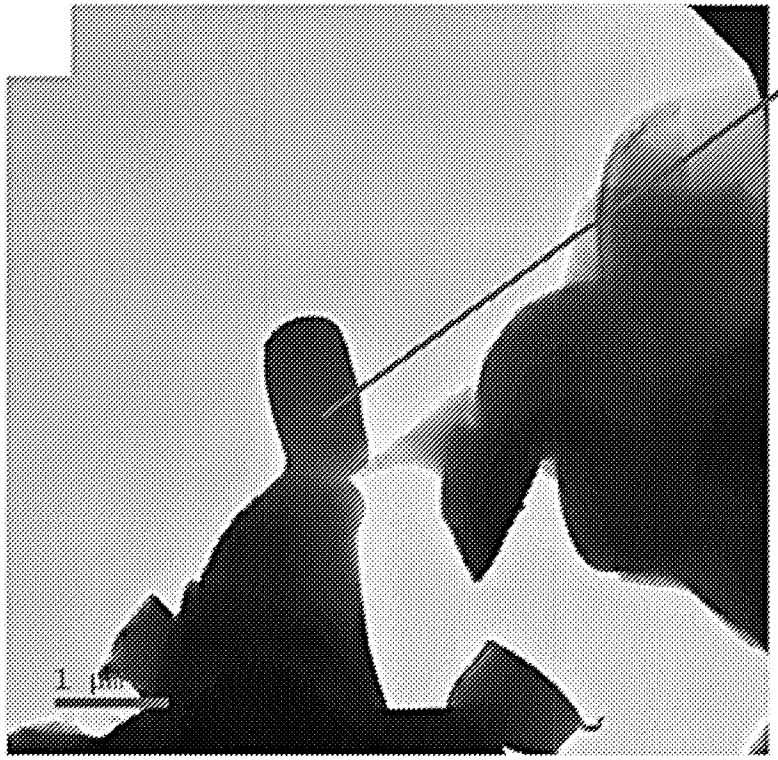
FIG. 5A illustrates BF TEM image of a precipitate in the dendritic region of as-cast $Fe_{40.2}Ni_{11.3}Mn_{30}Al_{7.5}C_{11}$.
Figure 5B:
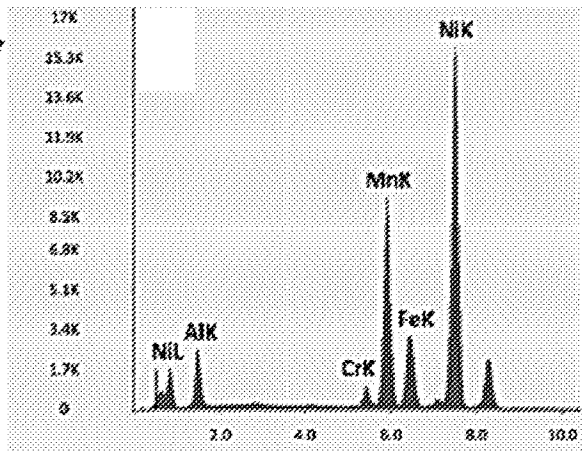
FIG. 5B illustrates TEM EDS spectrum revealing the particle is enriched in Ni.
Figure 5C:
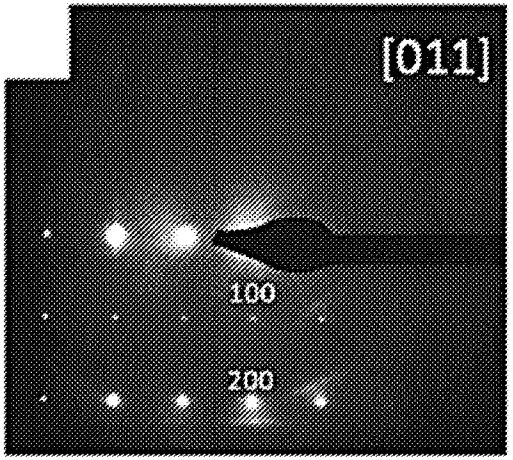
FIG. 5C illustrates corresponding [011] SADP showing (100) reflections indicating a B2 structure.

Example 1: Microstructures of as-cast $Fe_{40.2}Ni_{11.3}Mn_{30}Al_{7.5}Cr_{11}$ The dendritic-interdendritic, three-phase microstructure of as-cast $Fe_{40.2}Ni_{11.3}Mn_{30}Al_{7.5}Cr_{11}$ is shown in the BSE image (FIG. 1). The volume fractions of the dendritic and interdendritic regions are 46% and 54%, respectively. FIG. 2A is a Bright Field TEM image of an interdendritic region in the as-cast alloy. FIG. 2B shows that high concentrations of Fe and Mn are present in this region, and the corresponding [112] SADP (FIG. 2C) indicates that the crystal structure is f.c.c. The STEM-EDS maps from a dendritic region (FIG. 3) shows that it is enriched in Cr and the point marked Object 1 in the maps corresponds to the [123] SADP in FIG. 4 which indicates the crystal structure of the dendrite is b.c.c. FIG. 3 also shows the presence of small precipitates enriched in Ni, Mn and Al. FIG. 5A is a BF TEM image of a precipitate located within the dendrite which is enriched in Ni (FIG. 5B), and the corresponding [011] SADP (FIG. 5C) shows (100) reflections, indicating B2 order. The average particle diameter of B2 precipitates within the dendritic regions is 1.3±0.1 μm.

Figure 6A:
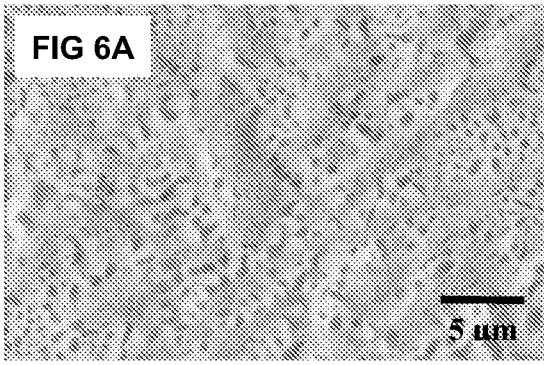
FIGS. 6A-6C illustrates BSE images of $Fe_{40.2}Ni_{11.3}Mn_{30}Al_{7.5}C_{11}$ annealed for 1 h at (FIG. 6A) 1173 K.
Figure 6B:
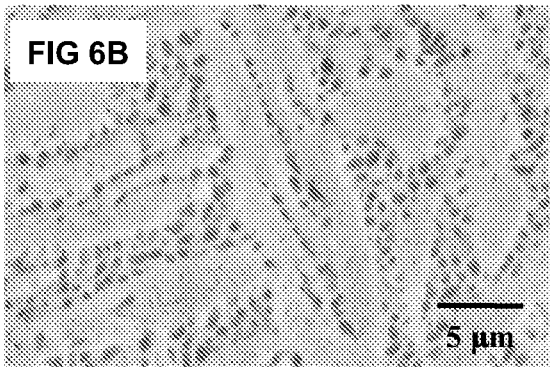
Figure 6C:
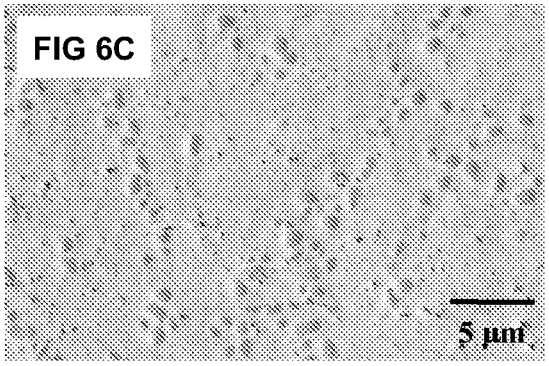
Figure 6D:
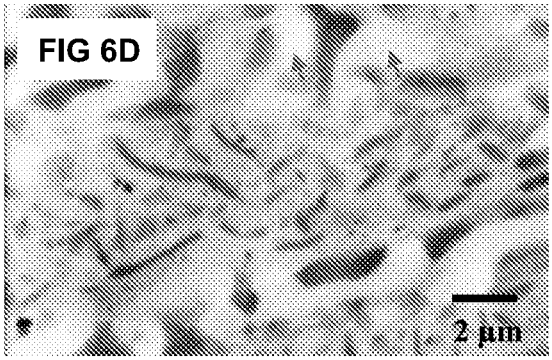
FIGS. 6D and 6E illustrate the magnified images of the 1173 K and 1223 K annealed specimens showing needle-shaped precipitates within the interdendritic regions. The arrows indicate the white precipitates located at the dendritic/interdendritic interfaces.
Figure 6E:
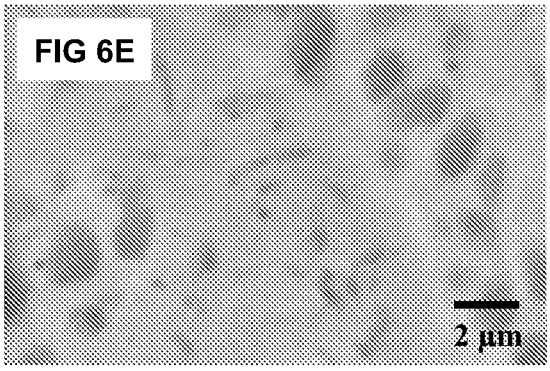
Figure 7:
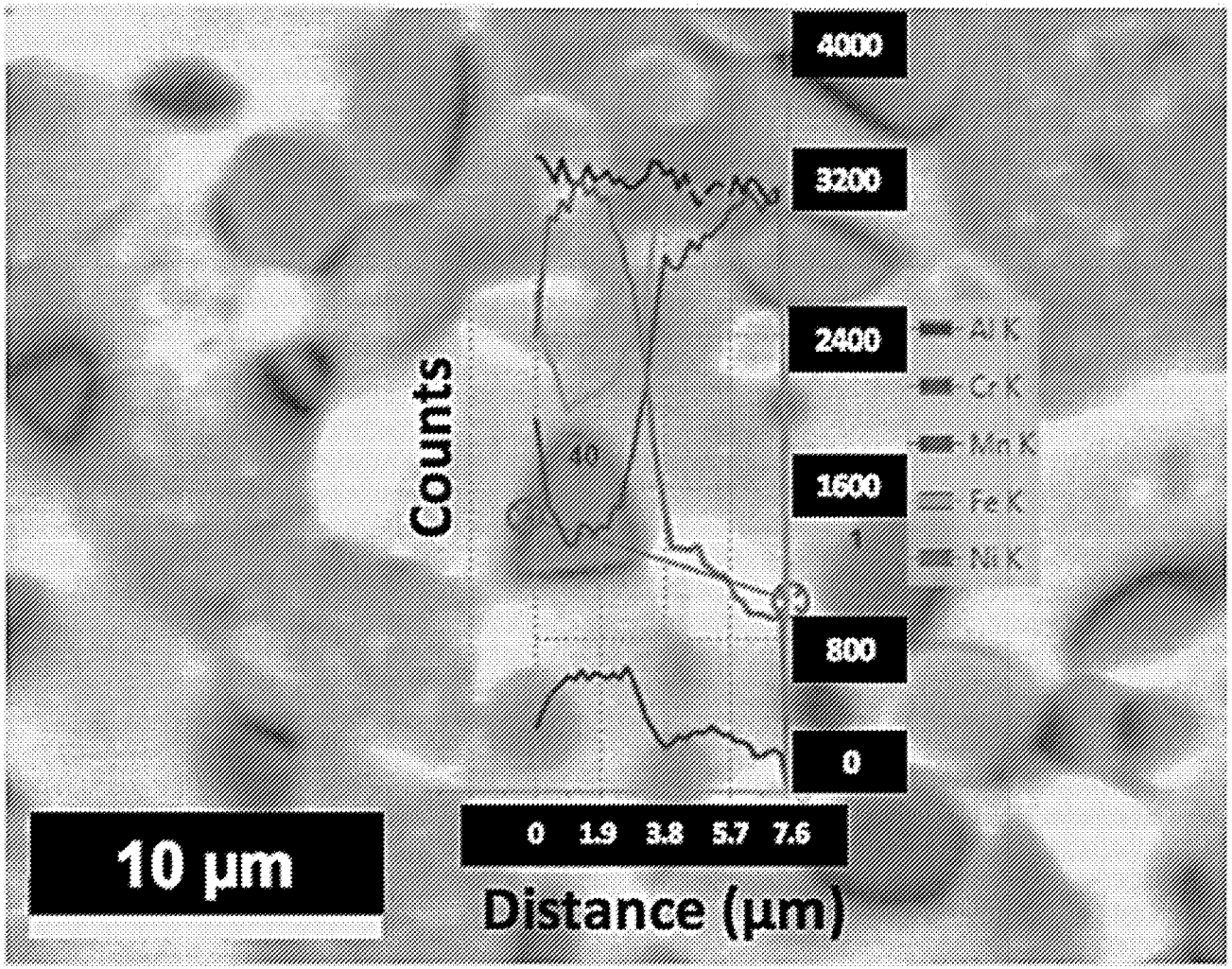
FIG. 7 illustrates EDS line profile across a dark and white precipitate in $Fe_{40.2}Ni_{11.3}Mn_{30}Al_{7.5}C_{11}$ annealed 1173 K for 1 h. The dark precipitate has a higher Ni content than the white precipitate, while the latter has a higher Cr content.

Example 2: Microstructures of $Fe_{40.2}Ni_{11.3}Mn_{30}Al_{7.5}Cr_{11}$ Annealed at 1173 K, 1223 K, 1273 K The microstructural evolution for $Fe_{40.2}Ni_{11.3}Mn_{30}Al_{7.5}Cr_{11}$ annealed for 1 h at 1173 K, 1223 K, and 1273 K are shown in FIGS. 6A-E. The dendritic-interdendritic microstructure is still present in specimens annealed at either 1173 K (FIG. 6A) or 1223 K (FIG. 6B) in addition to needle-shaped precipitates located within the interdendrites. A higher volume fraction (28%) of interdendritic needle-shaped precipitates are observed in the magnified images of the specimen annealed at 1173 K for 1 h (FIG. 6D) compared to the volume fraction (15%) observed for the specimen annealed at 1223 K for 1 h (FIG. 6E). When the material is annealed at 1273 K for 1 h, the needle-shaped precipitates have disappeared and only 8.5% volume fraction of dark spherical precipitates are present (FIG. 6C) compared to the volume fraction (16.7%) in the 1173 K annealed specimen. It should be noted that in addition to the dark spherical particles, white precipitates, indicated by arrows, are located at the dendritic/interdendritic interfaces in the material annealed at 1173 K for 1 h (FIG. 6D). According to the line profile in FIG. 7, the dark precipitate has a higher Ni content than the white precipitate, which in turn has a higher Cr content. Table 1 lists the STEM-EDS chemical compositions in at. % of the dark and white precipitates located in the dendritic regions.

TABLE 1

STEM-EDS chemical compositions (at. %) from the dark and white precipitates located within the dendritic regions. The dark particles are enriched in Ni while the white particles are enriched in Cr. Standard deviation bars are from 3 measurements.

| Element | Dark Precipitate | White Precipitate |
|---|---|---|
| Ni | 30.4 ± 0.3 | 6.0 ± 0.2 |
| Fe | 21.3 ± 0.1 | 32.6 ± 1.0 |
| Cr | 7.4 ± 0.01 | 32.6 ± 0.1 |
| Mn | 28.4 ± 0.03 | 28.1 ± 0.9 |
| Al | 12.2 ± 0.02 | 0.7 ± 0.04 |

Figure 8A:
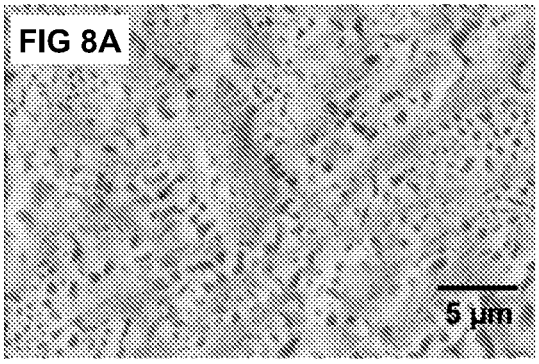
FIGS. 8A-8C illustrates $Fe_{40.2}Ni_{11.3}Mn_{30}Al_{7.5}C_{11}$ annealed at 1173 K for (FIG. 8A) 1 h, (FIG. 8B) 4 h, and (FIG. 8C) 100 h.
Figure 8B:
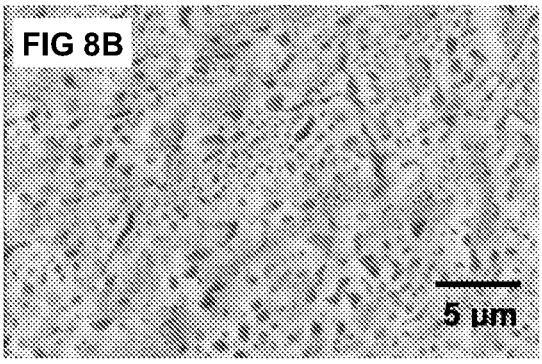
Figure 8C:
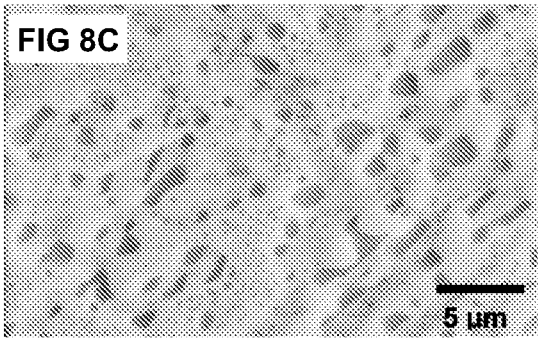
Figure 8D:
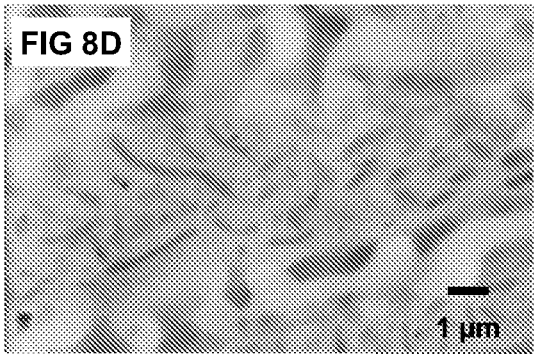
FIGS. 8D and 8E illustrate needle-shaped precipitates in the interdendrites observed in the magnified images of the (FIG. 8D) 1 h and (FIG. 8E) 4 h annealed samples. Additionally, coarsened dark and white precipitates are observed after 4 h and 100 h of annealing time, with the latter containing small spherical particles in the dendritic regions as well.
Figure 8E:
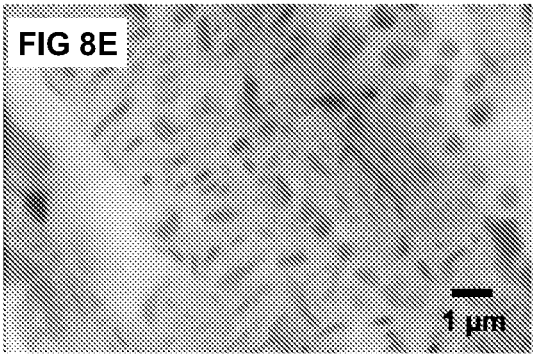

FIGS. 8A-E shows the microstructural evolution of $Fe_{40.2}Ni_{11.3}Mn_{30}Al_{7.5}Cr_{11}$ annealed at 1173 K for 1 h (FIG. 8A), 4 h (FIG. 8B) and 100 h (FIG. 8C). Once again, needle-shaped precipitates in the interdendritic regions are observed in the magnified images of the 1 h (FIG. 8D) and 4 h (FIG. 8E) annealed samples. However, after 100 h of annealing time, the interdendritic needle-shaped precipitates have almost entirely disappeared and the microstructure is characterized by fully coarsened white and dark precipitates within the dendrites. Smaller, spherical particles with an average diameter of 316±0.1 nm are observed alongside the dendritic particles as well.

Figure 9:
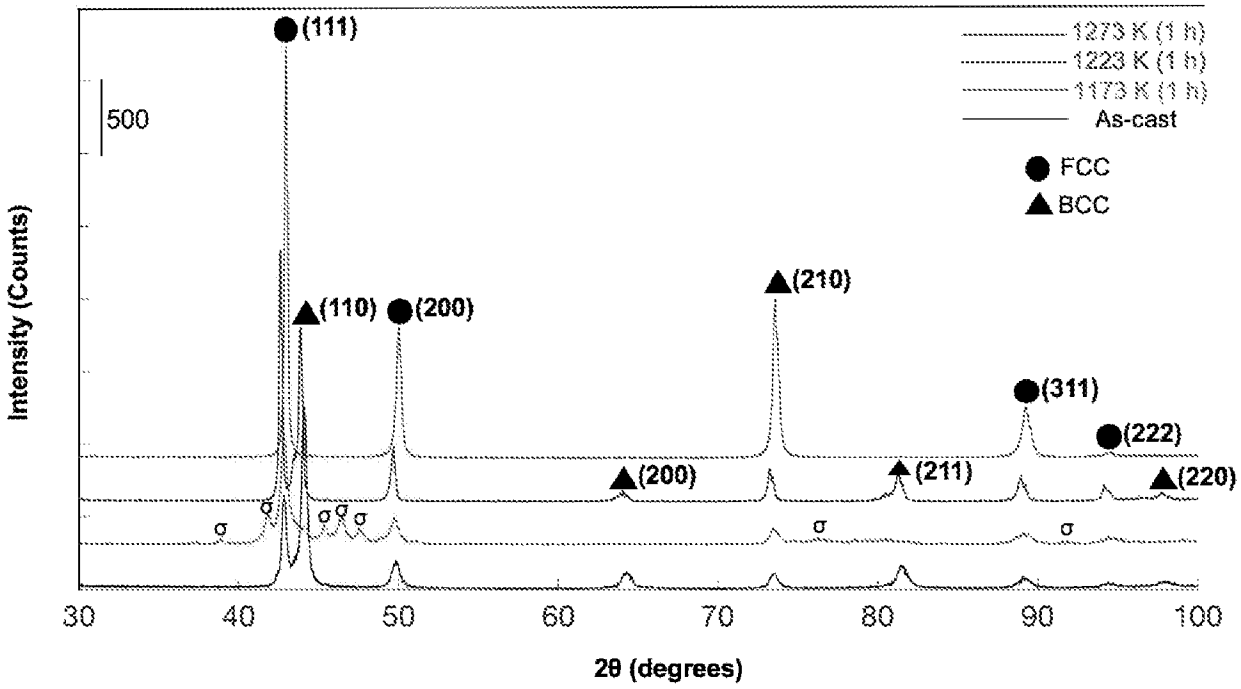
FIG. 9 illustrates XRD patterns from as-cast and annealed $Fe_{40.2}Ni_{11.3}Mn_{30}Al_{7.5}Cr_{11}$ for 1 h at 1173 K, 1223 K, and 1273 K.

FIG. 9 shows XRD patterns of as-cast and annealed $Fe_{40.2}Ni_{11.3}Mn_{30}Al_{7.5}Cr_{11}$. The spectrum from the as-cast alloy is comprised of b.c.c. and f.c.c. peaks. After annealing at 1173 K for 1 h, the (111) peak intensity of the f.c.c. phase has increased and the (110) b.c.c. peak has been replaced by a new set of peaks corresponding to the σ phase. The σ phase is enriched in Fe and Cr (50:50) and has a tetragonal crystal structure with lattice constants a=8.98 Å and c=4.55 Å. After annealing at 1223 K for 1 h, the σ phase peaks have disappeared and the pattern is comprised of only f.c.c. and b.c.c. peaks, although the intensity of the $(110)_{BCC}$ peak has decreased relative to its intensity in the as-cast state while the $(111)_{FCC}$ peak intensity has increased. After annealing at 1273 K for 1 h, the pattern is comprised of almost entirely f.c.c. peaks.

Figure 10:
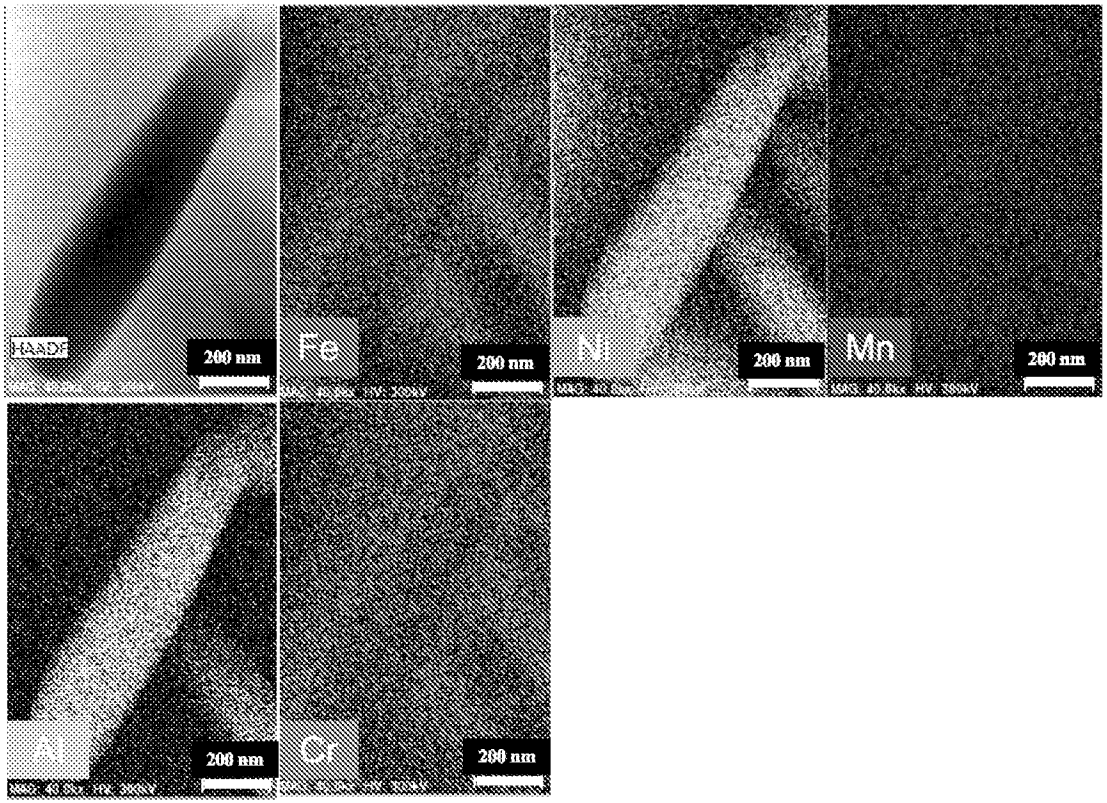
FIG. 10 illustrates STEM-HAADF image of the needle-shaped precipitate within the interdendritic regions in the material annealed at 1173 K for 1 h and the corresponding STEM-EDS maps show that it is enriched in Ni and Al.
Figure 11:
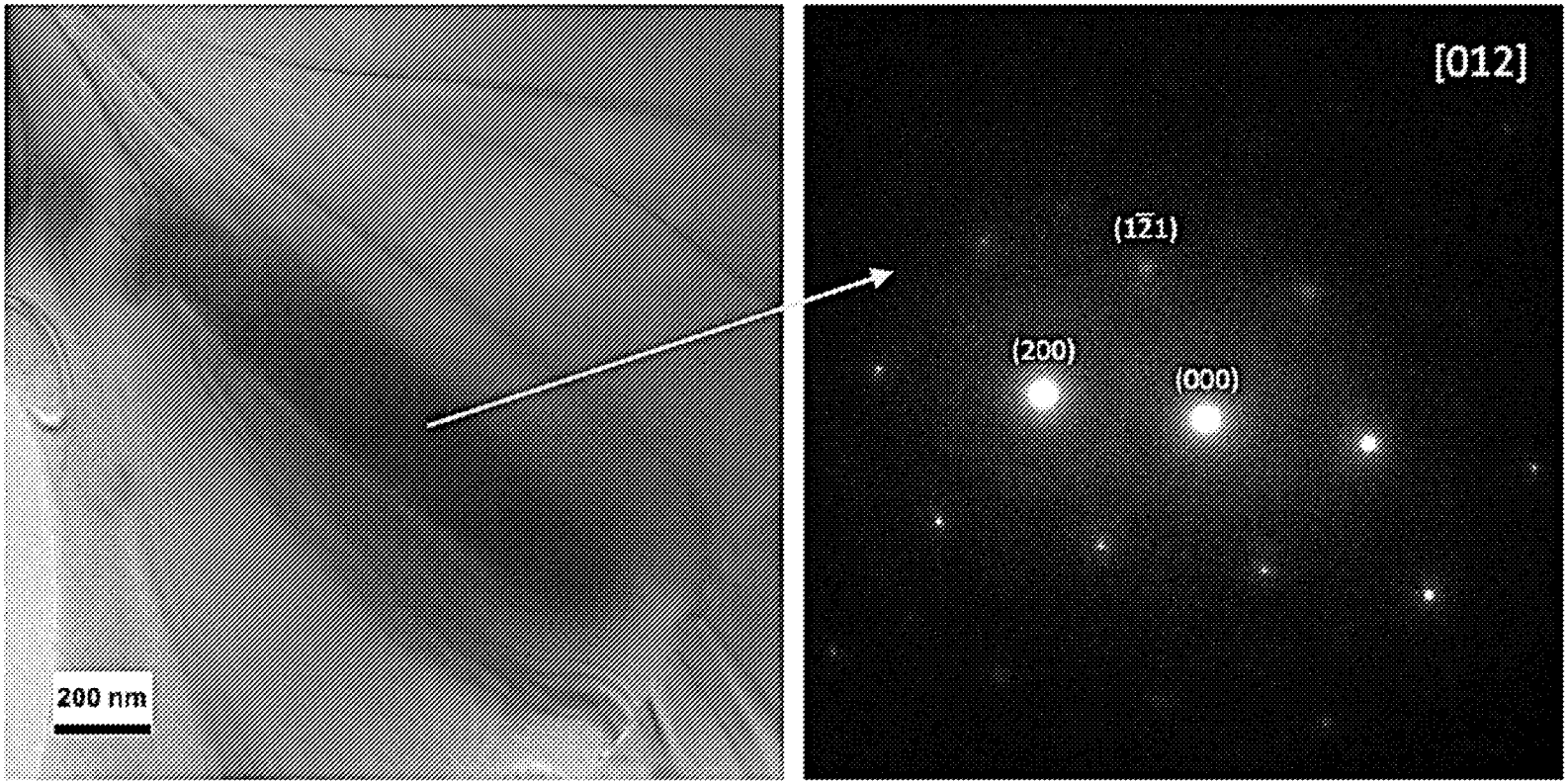
FIG. 11 illustrates BF TEM image of the needle-shaped precipitate within the intendendritic regions in the material at 1173 K for 1 h and corresponding [012] SADP indicating the crystal structure is b.c.c.
Figure 12:
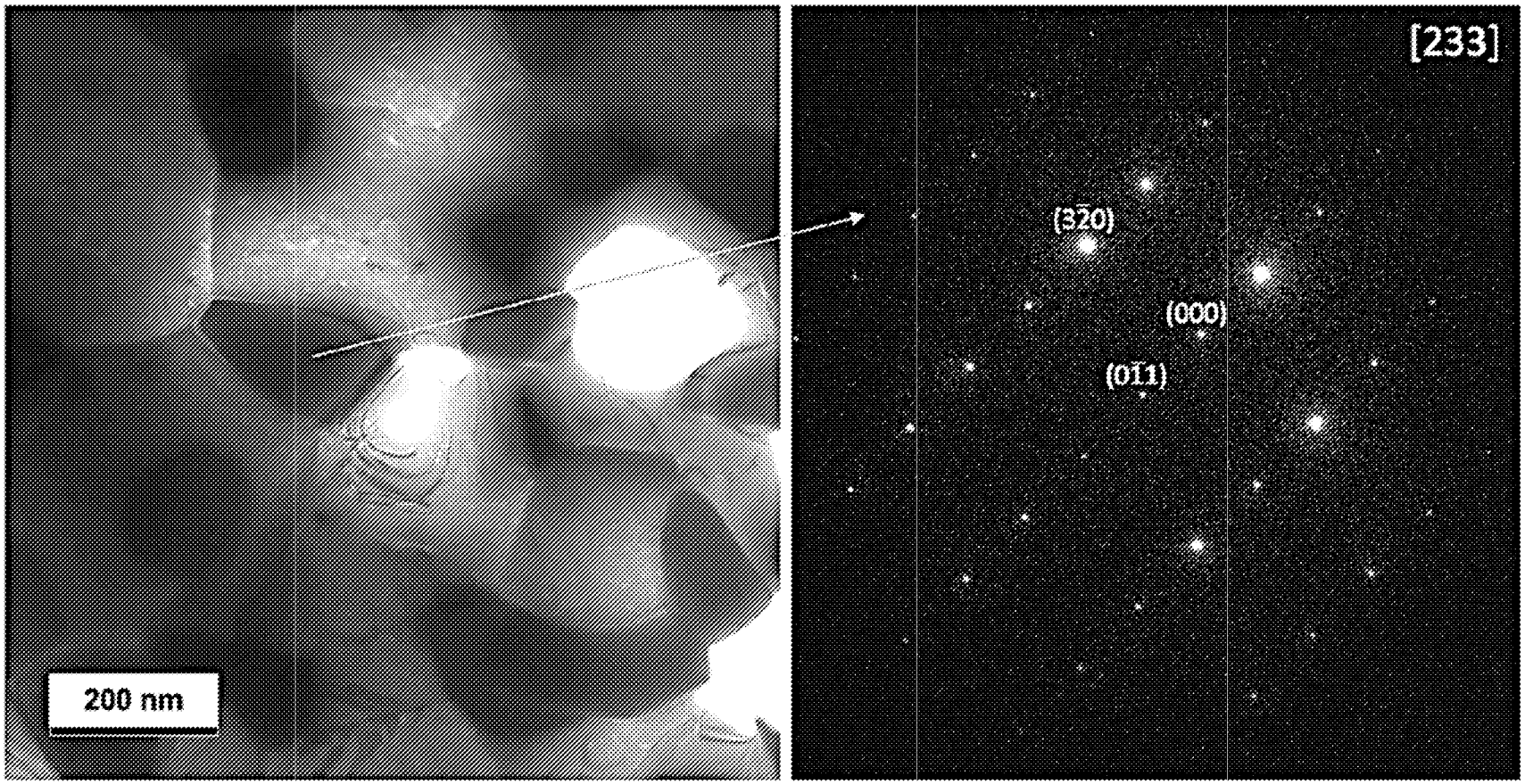
FIG. 12 illustrates BF TEM image of the sigma precipitate within the dendritic regions in the material at 1173 K for 1 h and corresponding [233] SADP indicating the crystal structure is tetragonal.
Figure 13:
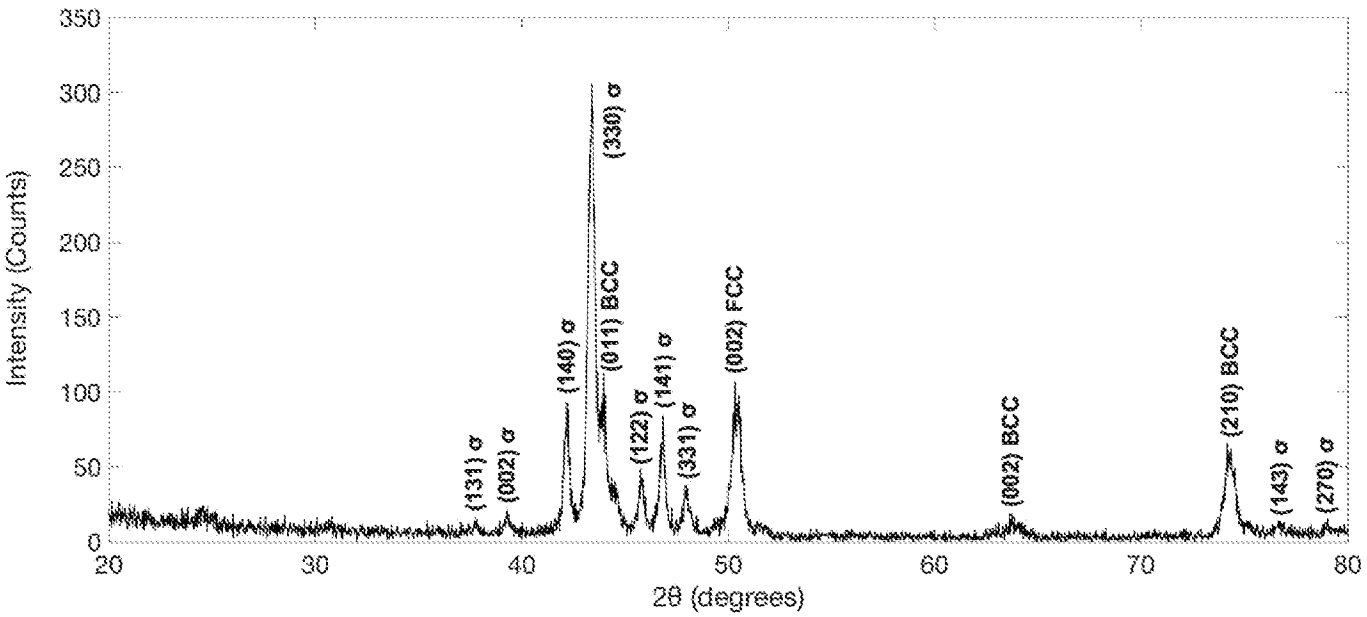
FIG. 13 illustrates XRD pattern from $Fe_{40.2}Ni_{11.3}Mn_{30}Al_{7.5}Cr_{11}$ annealed at 1173 K for 100 h containing b.c.c., f.c.c., and σ phase peaks.

FIG. 10 is a STEM-HAADF image of an interdendritic needle-shaped precipitate and the corresponding STEM-EDS maps show that the particle is enriched in Ni and Al. FIG. 11 is a BF TEM image of the needle-shaped precipitate in the interdendritic regions of the material annealed at 1173 K for 1 h and its corresponding [012] SADP which shows the crystal structure is b.c.c. FIG. 12 is a BF TEM image of the sigma precipitate within the dendritic regions in the material at 1173 K for 1 h and the corresponding [233] SADP indicating the crystal structure is tetragonal. FIG. 13 is an XRD pattern from the alloy annealed at 1173 K for 100 h, showing characteristic b.c.c, f.c.c., and σ phase peaks. Table 2 outlines the crystal structures present for $Fe_{40.2}Ni_{11.3}Mn_{30}Al_{7.5}C_{11}$ in the as-cast state and after annealing for the indicated conditions.

TABLE 2

An outline of the crystal structures present for $Fe4_{0.2}Ni_{11.3}Mn_{30}Al_{7.5}Cr_{11}$ in the as-cast state and after annealing for the indicated conditions

| Condition | FCC | BCC | B2 | σ |
|---|---|---|---|---|
| As-cast | • | • | • | |
| 1173 K (1 h) | • | • | • | • |
| 1173 K (100 h) | • | • | • | • |
| 1223 K (1 h) | • | • | • | |
| 1273 K (1 h) | • | • | • | |

Figure 14A:
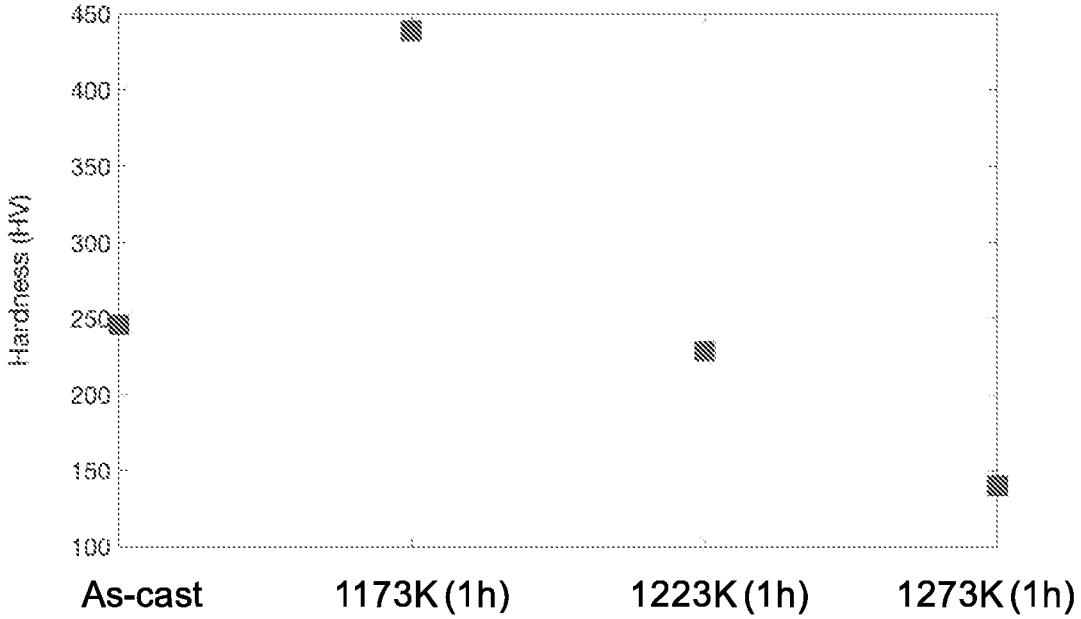
FIG. 14A illustrates Vickers micro-hardness values for $Fe_{40.2}Ni_{11.3}Mn_{30}Al_{7.5}Cr_{11}$ in the as-cast state and annealed for 1 h at 1173K, 1223 K, and 1273 K.
Figure 14B:
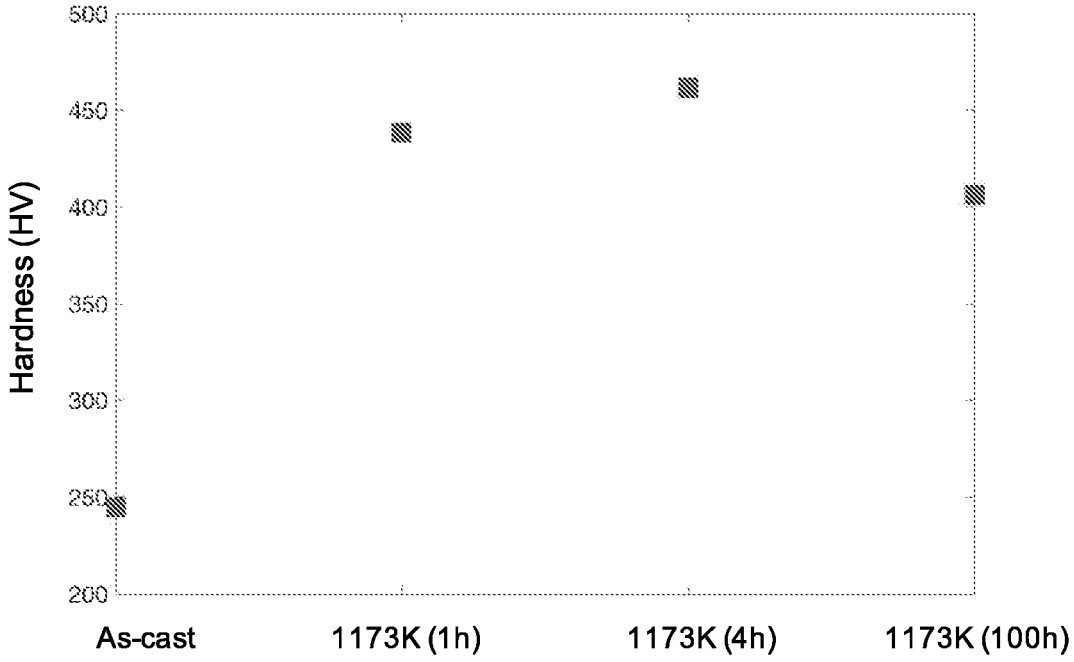
FIG. 14B illustrates Vickers micro-hardeness values for $Fe_{40.2}Ni_{11.3}Mn_{30}Al_{7.5}Cr_{11}$ in the as-cast state and annealed at 1173 K for 1 h, 4 h, and 100 h.
Figure 15A:
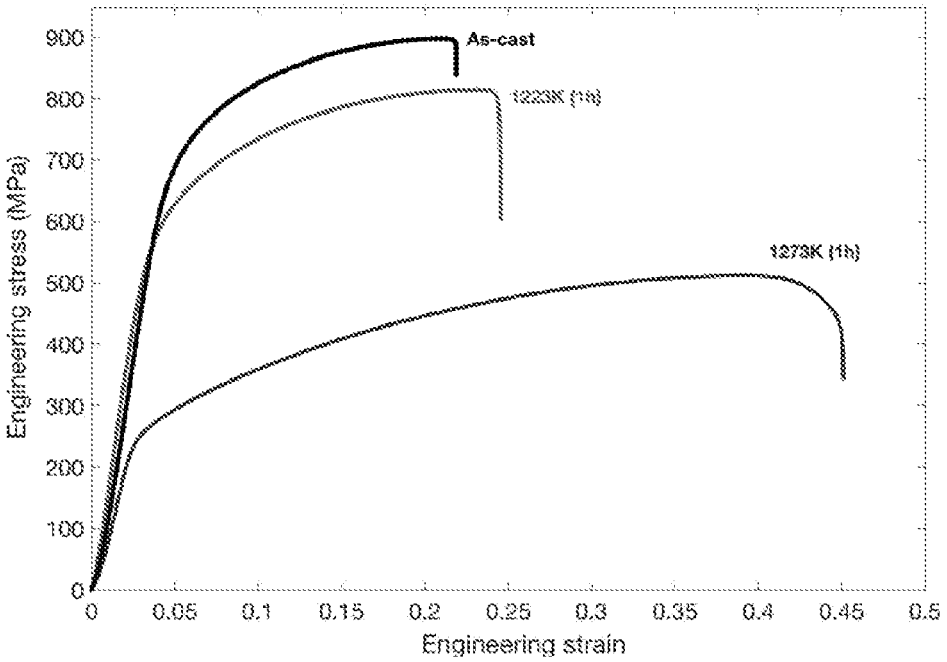
FIG. 15A illustrates stress-strain curves for $Fe_{40.2}Ni_{11.3}Mn_{30}Al_{7.5}Cr_{11}$ in the as-cast state and after being annealed for 1 h at 1223 K and 1273 K.
Figure 15B:
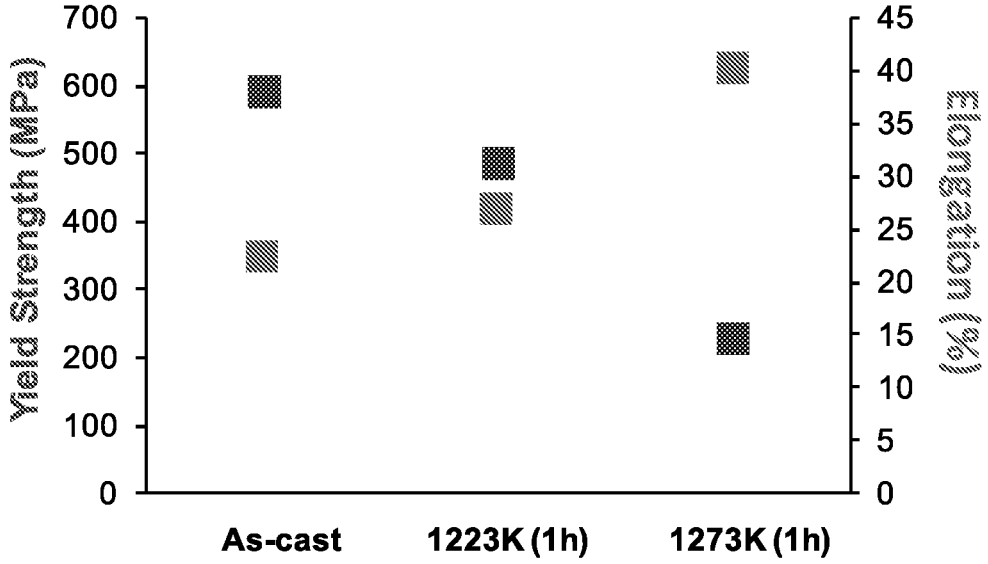
FIG. 15B elongation to fracture and yield strength values for the alloy in the as-cast condition and after being annealed for 1 h at 1223 K and 1273.

Example 3: Mechanical Properties of as-Cast and Annealed $Fe_{40.2}Ni_{11.3}Mn_{30}Al_{7.5}Cr_{11}$ The corresponding Vickers micro-hardness values for $Fe_{40.2}Ni_{11.3}Mn_{30}Al_{7.5}C_{11}$ in the as-cast state and after annealing for 1 h at 1173 K, 1223 K, and 1273 K are shown in FIG. 14A. After 1 h of annealing at 1173 K, the as-cast hardness value of ~246 HV has increased to ~439 HV. When the alloy is annealed for 1 h at 1223 K and 1273 K, the hardness values are ~229 and ~140 HV, respectively. When held at 1173 K, an initial increase in hardness is observed with increasing annealing time from ~439 HV after 1 h to ~462 HV after 4 h (FIG. 14B). After 100 h, the hardness decreases to ~406 HV. Due to the significant hardness values for the 1173 K aged material, which suggests high strength at the expense of ductility, a temperature range between 1223 K-1273 K was selected to optimize the alloy's mechanical properties. Stress-strain curves for $Fe_{40.2}Ni_{11.3}Mn_{30}Al_{7.5}Cr_{11}$ in the as-cast condition and after annealing for 1 h at 1223 K and 1273 K h can be seen in FIG. 15A. The elongation to fracture gradually increases from ~22% for the as-cast alloy to ~27% after annealing at 1223 K, and finally to ~40% after annealing at 1273 K. Simultaneously, the yield strength linearly decreases with an increase in annealing temperature from ~593 MPa for the as-cast alloy to ~486 MPa and ~228 MPa for specimens annealed for 1 h at 1223 K and 1273 K, respectively. A summary of the mechanical properties is provided in FIG. 15B.

Figure 16A:
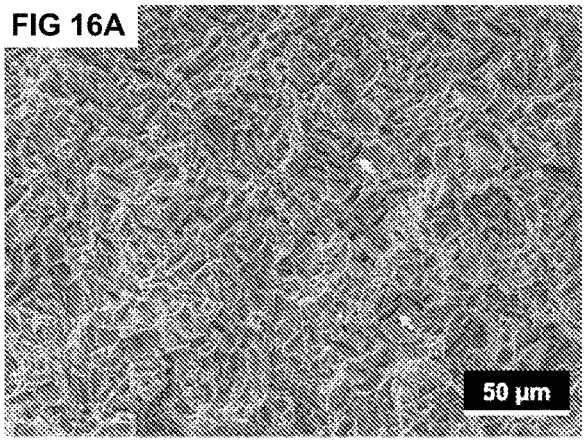
FIGS. 16A and 16B illustrate SE images from the tensile fracture surfaces of as-cast $Fe_{40.2}Ni_{11.3}Mn_{30}Al_{7.5}Cr_{11}$ revealing dimple-type rupture. Arrows indicate the presence of microvoids.
Figure 16B:
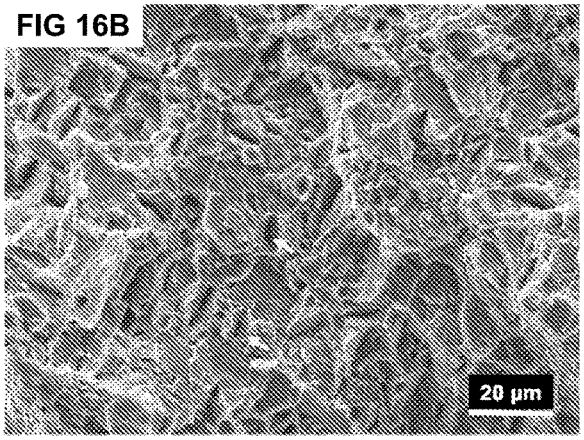
Figure 16C:
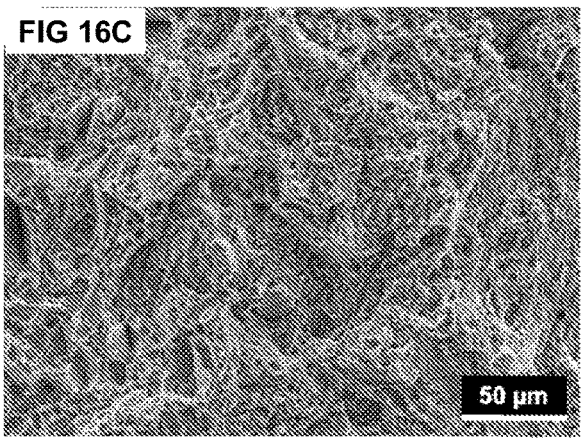
FIGS. 16C and 16D illustrate specimens annealed for 1 h at (FIG. 16C) 1223 K and (FIG. 16D) 1273 K also show dimple-type rupture with larger microvoids observed for the higher-temperature annealed material.
Figure 16D:
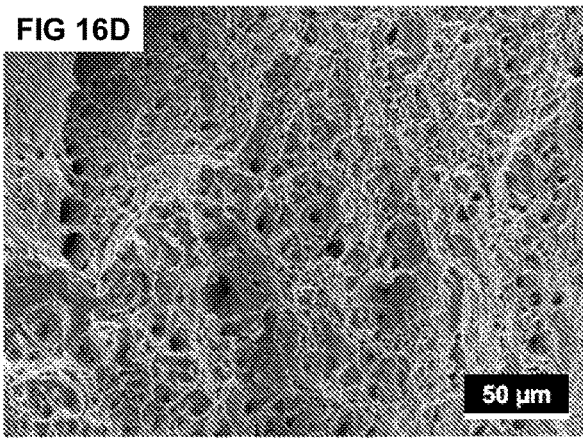
Figure 17A:
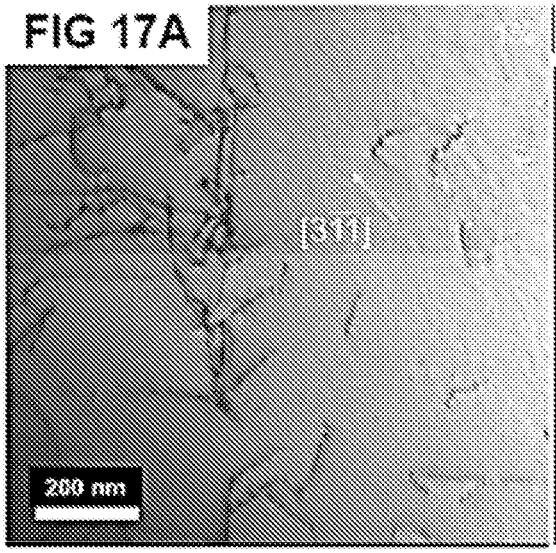
Figure 17B:
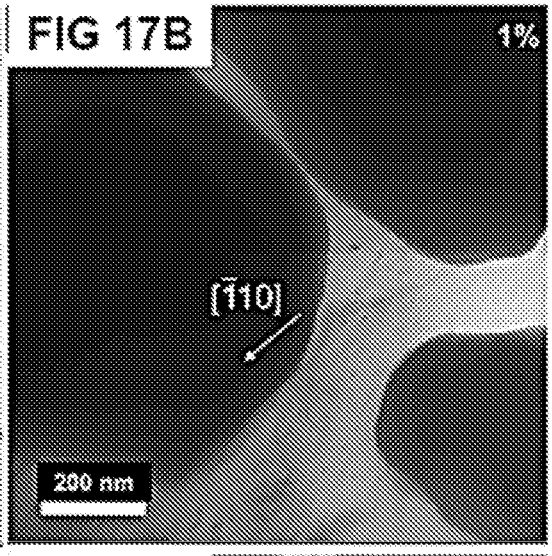
Figure 17C:
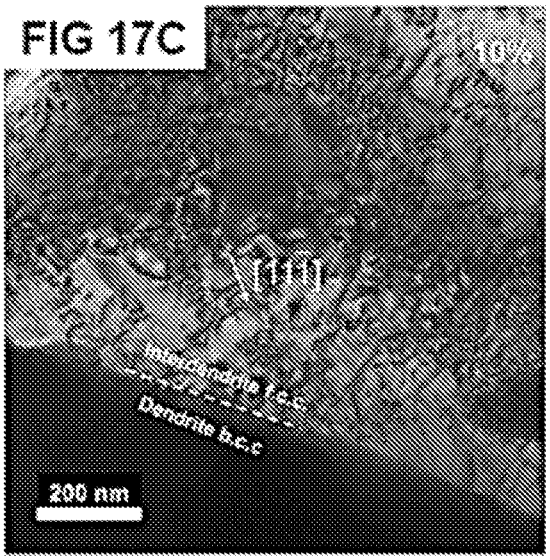
Figure 17E:
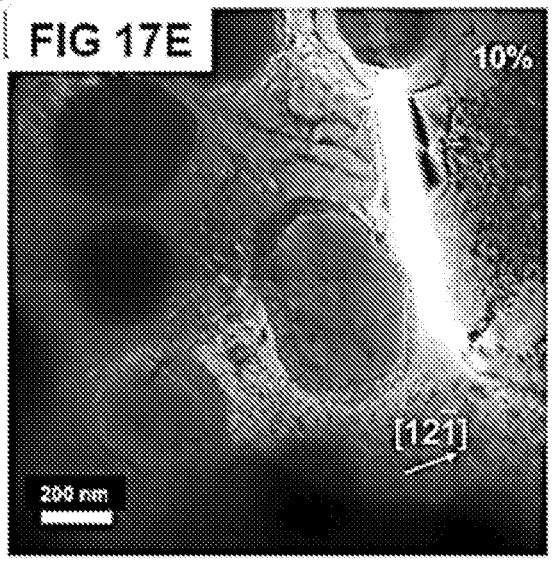
Figure 17F:
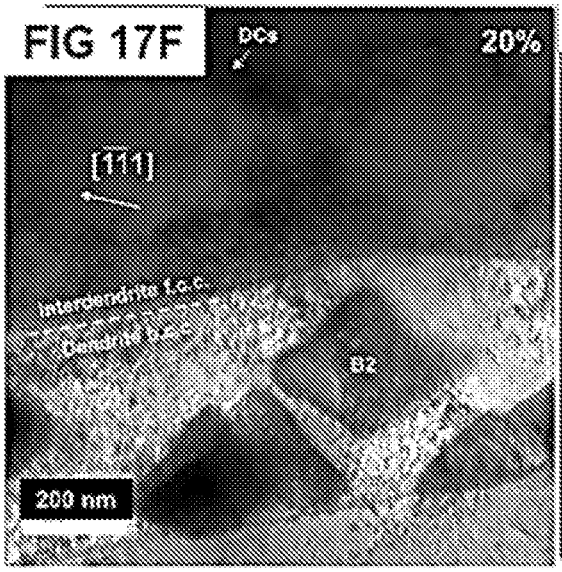
Figure 17G:
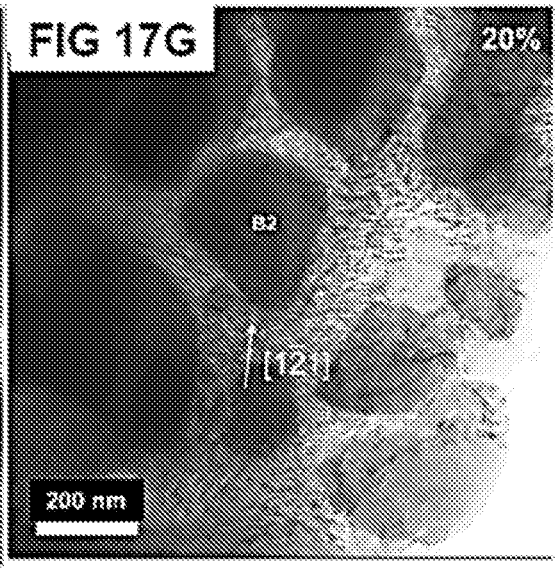

Example 4: Fracture Surface of as-Cast $Fe_{40.2}Ni_{11.3}Mn_{30}Al_{7.5}Cr_{11}$ The fracture surfaces for the as-cast alloy can be seen in FIGS. 16A & 16B. Ductile dimples are observed on the fracture surface of the specimen and elongated microvoids (indicated by arrows) are located within the dimples. Specimens annealed for 1 h at 1223 K (FIG. 16C) and 1273 K (FIG. 16D) also show dimple-type rupture with larger microvoids observed for the higher temperature annealed material.

Example 5: Dislocation Substructures in as-Cast $Fe_{40.2}Ni_{11.3}Mn_{30}Al_{7.5}Cr_{11}$ The dislocation substructures for the as-cast $Fe_{40.2}Ni_{11.3}Mn_{30}Al_{7.5}Cr_{11}$ alloy are shown in FIGS. 17A-B and 17C-G. After (FIG. 17A) 1% strain, the dislocations in the interdendritic regions appear as loops that, upon further straining to (FIG. 17C) 10%, become entangled as a result of cross-slip. After (FIG. 17F) 20% strain, extensive cross-slipping produces dislocation cells within the interdendritic regions. In comparison, few dislocations are seen in the dendritic regions after (FIG. 17B) 1% strain, which indicates that the dendrites remain relatively undeformed. However, with higher strains of (FIG. 17E) 10% and (FIG. 17G) 20%, the dislocation density increases and moreover, accumulates around the B2 particles.

REFERENCES

[1] J. W. Yeh et al., "Nanostructured high-entropy alloys with multiple principal elements: Novel alloy design concepts and outcomes," *Adv. Eng. Mater.*, vol. 6, no. 5, p. 299-303, 2004.

[2] E. J. Pickering and N. G. Jones, "High-entropy alloys: a critical assessment of their founding principles and future prospects," *Int. Mater. Rev.*, vol. 6608, no. May, pp. 1-20, 2016.

[3] Y. Lu, X. Gao, L. Jiang, Z. Chen, and T. Wang, "Directly cast bulk eutectic and near-eutectic high entropy alloys with balanced strength and ductility in a wide temperature range," *Acta Mater.*, vol. 124, pp. 143-150, 2017.

[4] X. Gao et al., "Microstructural origins of high strength and high ductility in an AlCoCrFeNi2.1 eutectic high-entropy alloy," *Acta Mater.*, vol. 141, pp. 59-66, 2017.

[5] A. M. Giwa, P. K. Liaw, K. A. Dahmen, and J. R. Greer, "Microstructure and small-scale size effects in plasticity of individual phases of $Al_{0.7}$CoCrFeNi High Entropy alloy," *Extrem. Mech. Lett.*, vol. 8, pp. 220-228, 2016.

[6] G. Liu et al., "Intermetallics Microstructure and mechanical properties of $Al_{0.7}$CoCrFeNi high-entropy-alloy prepared by directional solidification," *Intermetallics*, vol. 93, no. December 2017, pp. 93-100, 2018.

[7] F. Meng, J. Qiu, and I. Baker, "The effects of chromium on the microstructure and tensile behavior of Fe30Ni20Mn35Al15," *Mater. Sci. Eng. A*, vol. 586, pp. 45-52, December 2013.

[8] C. G. Mckamey et al., "Effect of Chromium on room-temperature ductility and fracture mode in $Fe_3Al$," *Scr. Metall*, vol. 22, pp. 1679-1681, 1988.

[9] C. G. Mckamey, J. A. Horton, and C. T. Liu, "Effect of chromium on properties of $Fe_3Al$," vol. 4, no. 5, 1989.

[10] C. Tung, J. Yeh, T. Shun, S. Chen, Y. Huang, and H. Chen, "On the elemental effect of AlCoCrCuFeNi high-entropy alloy system," vol. 61, pp. 1-5, 2007.

[11] M. Tsai et al., "Intermetallics Significant hardening due to the formation of a sigma phase matrix in a high entropy alloy," *Intermetallics*, vol. 33, pp. 81-86, 2013.

[12] M. Tsai et al., "Significant hardening due to the formation of a sigma phase matrix in a high entropy alloy," *Intermetallics*, vol. 33, pp. 81-86, 2013.

[13] D. M. E. Villanueva et al., "Comparative study on sigma phase precipitation of three types of stainless steels: austenitic, superferritic and duplex Comparative study on sigma phase precipitation of three types of stainless steels: austenitic, superferritic and duplex," vol. 836, 2013.

[14] C. Hsieh and W. Wu, "Overview of Intermetallic Sigma (a) Phase Precipitation in Stainless Steels," *ISRN Metall.*, vol. 2012, no. 4, 2012.

[15] S. Chen et al., "Microstructure and properties of age-hardenable AlxCr1.5MnNi0.5 alloys," *Mater. Sci. Eng. A*, vol. 527, pp. 5818-5825, 2010.

[16] Y. Liao and I. Baker, "On the room-temperature deformation mechanisms of lamellar-structured Fe30Ni20Mn35Al15," *Mater. Sci. Eng. A*, vol. 528, no. 12, pp. 3998-4008, May 2011.

[17] F. Meng, J. Qiu, and I. Baker, "Effect of Al content on the microstructure and mechanical behavior of two-phase FeNiMnAl alloys," *J. Mater. Sci.*, vol. 49, no. 5, pp. 1973-1983, 2014.

We claim:

1. A high-entropy alloy (HEA) having a formula of $Fe_aNi_bMn_cAl_dCr_eC_f$ wherein a is between 37-43 atomic %, b is between 8-14 atomic %, c is between 27-33 atomic %, d is between 4-10 atomic %, e is between 10-14 atomic %, and f is between 0-2 atomic %, wherein the HEA has a three-phase structure which comprises FeMn-enriched laths and NiAl-rich precipitates inside Cr-concentrated regions.

2. The HEA of claim 1, wherein f is between 0.5 and 1.1 atomic %.

3. The HEA of claim 1 having the formula $Fe_{40.2}Ni_{11.3}Mn_{30}Al_{7.5}Cr_{11}$, wherein the composition is expressed in terms of atomic percentages.

4. The HEA of claim 1, wherein the HEA has a yield strength of at least 400 MPa at room temperature.

5. The HEA of claim 1, wherein the HEA has a yield strength of at least 450 MPa at room temperature.

6. The HEA of claim 1, wherein the HEA has a yield strength of at least 500 MPa at room temperature.

7. The HEA of claim 1, wherein the HEA has a yield strength of at least 550 MPa at room temperature.

8. The HEA of claim 1, wherein the HEA has a ductility of at least 20%.

9. The HEA of claim 1, wherein the HEA has a ductility of at least 22%.

10. A high-entropy alloy (HEA) having a formula of $Fe_aNi_bMn_cAl_dCr_e$, wherein a is between 37-43 atomic %, b is between 8-14 atomic %, c is between 27-33 atomic %, d is between 4-10 atomic %, and e is between 10-14 atomic %, wherein the HEA comprises a Cr-rich, b.c.c. and Fe,Mn-rich f.c.c. dendritic-interdendritic microstructure with Ni-rich particles dispersed within the Cr-rich region.

11. A multiphase high-entropy alloy (HEA) FeNiMnAlCr, comprising

Fe in an amount of between 37-43 atomic %;
Ni in an amount of between 8-14 atomic %;
Mn in an amount of between 27-33 atomic %;
Al in an amount of between 4-10 atomic %; and
Cr in an amount of between 10-14 atomic %,
wherein the HEA has a three-phase structure which comprises FeMn-enriched laths and NiAl-rich precipitates inside Cr-concentrated regions.

12. The multiphase HEA of claim 11, further comprising C in an amount of 0-2 atomic %.

13. The multiphase HEA of claim 11 having the formula $Fe_{40.2}Ni_{11.3}Mn_{30}Al_{7.5}Cr_{11}$, wherein the composition is expressed in terms of atomic percentages.

* * * * *